US011258150B2

(12) United States Patent
Meng

(10) Patent No.: US 11,258,150 B2
(45) Date of Patent: Feb. 22, 2022

(54) OUTWARDLY PROTRUDING TRIPLE-MODE CAVITY RESONANCE STRUCTURE AND FILTER WITH RESONANCE STRUCTURE

(71) Applicant: HONGKONG FINGU DEVELOPMENT COMPANY LIMITED, Hong Kong (CN)

(72) Inventor: Qingnan Meng, Hubei (CN)

(73) Assignee: HONGKONG FINGU DEVELOPMENT COMPANY LIMITED, Hong Kong (CN)

( * ) Notice: Subject to any disclaimer, the term of this patent is extended or adjusted under 35 U.S.C. 154(b) by 0 days.

(21) Appl. No.: 17/270,453

(22) PCT Filed: Dec. 29, 2018

(86) PCT No.: PCT/CN2018/125167

§ 371 (c)(1),
(2) Date: Feb. 23, 2021

(87) PCT Pub. No.: WO2020/062687

PCT Pub. Date: Apr. 2, 2020

(65) Prior Publication Data

US 2021/0257707 A1 Aug. 19, 2021

(30) Foreign Application Priority Data

Sep. 30, 2018 (CN) ..... 201811155099.7

(51) Int. Cl.
*H01P 7/10* (2006.01)
*H01P 1/20* (2006.01)
*H01P 1/208* (2006.01)

(52) U.S. Cl.
CPC ..... *H01P 1/2002* (2013.01); *H01P 1/2084* (2013.01); *H01P 1/2086* (2013.01); *H01P 7/105* (2013.01)

(58) Field of Classification Search
CPC ..... H01P 7/105; H01P 7/10; H01P 1/2084; H01P 1/2086; H01P 1/20; H01P 1/2002;
(Continued)

(56) References Cited

U.S. PATENT DOCUMENTS 5,268,659 A 12/1993 Zaki et al.
6,518,857 B1 2/2003 Hattori et al.

FOREIGN PATENT DOCUMENTS

CN 1269914 A 10/2000
CN 1325150 A 12/2001
(Continued)

OTHER PUBLICATIONS

Shen, Jianming, etc; <Study of ultra small dielectric filter for 5G-WiFi>; «Journal of Mechanical & Electrical Engineering» ;Jul. 31, 2017;p. 786-789; vol. 34 No. 7.

*Primary Examiner* — Stephen E. Jones
(74) *Attorney, Agent, or Firm* — Gang Yu

(57) ABSTRACT

The disclosure discloses an outwardly protruding triple-mode cavity resonance structure and a filter with the resonance structure. The structure includes a cavity (1) and a cover plate, wherein the cavity (1) is internally provided with a dielectric resonance block (2) and a dielectric support frame (3); at least one end face of the cavity (1) and/or the dielectric response block (2) protrudes outwards; the dielectric resonance block (2) and the dielectric support frame (3) form a triple-mode dielectric resonance rod; one end or any end of the cube-like dielectric resonance block (2) is connected with the dielectric support frame (3); the dielectric support frame (3) is connected with an inner wall of the cavity (1); and the dielectric response block (2) forms triple-mode resonance in three directions along the X, Y and Z axes of the cavity.

62 Claims, 5 Drawing Sheets

(58) Field of Classification Search
CPC ..... H01P 1/201; H01P 1/207; H01P 1/208;
H01P 1/2082
See application file for complete search history.

(56) References Cited

FOREIGN PATENT DOCUMENTS

| | | | |
|---|---|---|---|
| CN | 1472842 | A | 2/2004 |
| CN | 202474154 | U | 10/2012 |
| CN | 204088531 | U | 1/2015 |
| CN | 205159478 | U | 4/2016 |
| CN | 107181033 | A | 9/2017 |
| CN | 107946704 | A | 4/2018 |
| CN | 107946705 | A | 4/2018 |
| CN | 108336459 | A | 7/2018 |
| JP | H08186412 | A | 7/1996 |

OUTWARDLY PROTRUDING TRIPLE-MODE CAVITY RESONANCE STRUCTURE AND FILTER WITH RESONANCE STRUCTURE

CROSS REFERENCE TO RELATED APPLICATION(S)

The present invention is a national stage application of International Patent Application No. PCT/CN2018/125167, which is filed on Dec. 29, 2018 and claims priority to Chinese Patent Priority No. 201811155099.7, filed to the National Intellectual Property Administration, PRC on Sep. 30, 2018, entitled "Outwardly Protruding Triple-Mode Cavity Resonance Structure and Filter with Resonance Structure", the disclosure of which is hereby incorporated by reference in its entirety.

TECHNICAL FIELD

The disclosure relates to a base station filter, an antenna feeder filter, a combiner, an anti-interference filter and the like used in the field of wireless communications. Types of the filters may be band pass, band stop, high pass and low pass, and the disclosure particularly relates to an outwardly protruding triple-mode cavity resonance structure and a filter with the outwardly protruding triple-mode cavity resonance structure.

BACKGROUND

Along with the rapid development of 4G mobile communications to 5G mobile communications, miniaturization and high performance of communication facilities are increasingly highly required. Traditional filters are gradually replaced by single-mode dielectric filters due to large metallic cavity volume and ordinary performance, the single-mode dielectric filters mainly include a Transverse Electric 01 (TE01)-mode dielectric filter and a Transverse Magnetic (TM)-mode dielectric filter, the TE01-mode dielectric filter and the TM-mode dielectric filter generally adopt a single-mode dielectric resonance mode, and the resonance mode increases a certain Q value, but has defects of high manufacturing cost and large volume.

In order to solve technical problems of high cost and large volume of the single-mode dielectric filters, a triple-mode dielectric filter emerges at the right moment. In an art known to inventors, the triple-dielectric filter generally includes a TE triple-mode filter and a TM triple-mode filter. The TE triple-mode filter has the characteristics of being complex in coupling mode, large in volume and high in Q value, and the TM triple-mode filter has the characteristics of being simple in coupling mode, small in volume and low in Q value. With respect to a TE triple-mode filter and a TM triple-mode filter of a same frequency band, the weight, cost and volume of the TM triple-mode filter are greatly smaller than those of the TE triple-mode filter. Therefore, in the art known to inventors, the TE triple-mode filter is generally adopted to design a narrow band filter, and the TM triple-mode filter is generally used as other types of fitters. Since a dielectric resonance block of the TM triple-mode filter is coated by baked silver, a vitreous substance is formed between a silver layer after silver baking and a surface of the dielectric resonance block, thus actual conductivity is greatly degraded, the Q value is actually low, and the use range of the TM triple-mode filter is further limited. Therefore, how to obtain a TM triple-mode filter of a small volume and a high Q value is a new direction of research and development of filters.

The TM triple-mode filter known to inventors generally adopts a structure that a cube/cube-like/spherical dielectric resonance block is arranged in a cube/cube-like/spherical resonance cavity, the dielectric resonance block is supported by a dielectric base, and a ratio of a size of a single side of the resonance cavity to a size of a single side of the dielectric resonance block is generally greater than 1.6. When the volume of the resonance cavity is maintained and the volume of the dielectric resonance block is slightly increased, or the volume of the resonance cavity is slightly decreased and the volume of the dielectric resonance block is maintained, or the volume of the resonance cavity is slightly decreased and the volume of the dielectric resonance block is slightly increased, comparison of data provided by Table 1 shows that while the ratio of the size of the single side of the resonance cavity to the size of the single side of the dielectric resonance block is increased, a Q value of a base mode is increased along with increase of the ratio, a Q value of a higher-order mode is decreased along with increase of the ratio, the size of the dielectric resonance block is decreased along with increase of the ratio, the size of a cavity is continuously increased, when the size is approximate to a ¾ wavelength size of the cavity, the size of the dielectric resonance block is continuously decreased, the Q value of the base mode is also decreased, and a frequency of the higher-order mode is approximate to or far away from a frequency of the base mode along with increase of the ratio at times.

Cavity volumes of the resonance cavities corresponding to different ratios are also different and can be selected according to actual demands. Single cavities with a ratio of 1.6 or greater may be selected for cavities of different sizes in a ratio range in Table 1 and corresponding cube resonators when the performance requirement of filters is higher. Therefore, when the ratio of the size of the single side of the resonance cavity to the size of the single side of the dielectric resonance block is greater than 1.6, the Q value is proportional to a distance between the resonance cavity and the dielectric resonance block, but a defect that the volume of a filter is too large is caused.

The patent known to inventors discloses a triple-mode cavity structure with a small volume and a high Q value, and the structure ensures that the volume of a filter is effectively decreased and a Q value is increased while an outer surface of a dielectric resonance block and an inner surface of a cavity are arranged in parallel and the distance between the two surfaces is very small. However, such structure has the following technical problems: 1. Due to the very small distance between the dielectric resonance block and an inner wall of the cavity, the tuning range of a tuning screw is limited, and installation and debugging of the dielectric resonance block are obstructed; 2. Due to the very small distance between the dielectric resonance block and the inner wall of the cavity, the distance between the dielectric resonance block and the single cavity is very sensitive to a single cavity resonance frequency, and thus on-batch production of the dielectric resonance block is obstructed; and 3. Since the very small distance between the dielectric resonance block and the inner wall of the cavity is very sensitive to the single cavity resonance frequency, the design precision of the dielectric resonance block and the cavity is highly required, and thus the processing and manufacturing cost is increased.

TABLE 1

| Single cavity side length (mm) | Side length of dielectric resonance block | Q value | Ratio (single cavity side length/side resonance block) | Higher-order frequency | Dielectric constant and frequency |
|---|---|---|---|---|---|
| 48 | 23.4 | 30562 | 2.05 | 2327.00 | ER = 35, F: 1880 |
| 46 | 23.54 | 28770 | 1.95 | 2315.00 | ER = 35, F: 1880 |
| 44 | 23.75 | 26683 | 1.85 | 2295.00 | ER = 35, F: 1880 |
| 42 | 24.04 | 24308 | 1.75 | 2264.00 | ER = 35, F: 1880 |
| 40 | 24.4 | 21686 | 1.64 | 2224.00 | ER = 35, F: 1880 |
| 38 | 24.9 | 18783 | 1.53 | 2172.00 | ER = 35, F: 1880 |
| 36 | 25.7 | 15496 | 1.40 | 2081.00 | ER = 35, F: 1880 |

SUMMARY

In light of the defects of an art known to inventors, the disclosure aims to solve a technical problem of providing an outwardly protruding triple-mode cavity resonance structure and a filter with the resonance structure, and the structure is capable of reducing overall insertion loss of the filter to meet requirements of a cavity filter on small insert and smaller volume.

The disclosure discloses an outwardly protruding triple-mode cavity resonance structure which includes a cavity and a cover plate, wherein the cavity is internally provided with a dielectric resonance block and a dielectric support frame; the cavity takes a cube-like shape; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block; when a ratio K of the size of a single side of the inner wall of the cavity to the size of a single side of the dielectric resonance block is: when K is greater than or equal to a transition point 1 and is smaller than or equal to a transition point 2, a Q value of a higher-order mode adjacent to a base mode is transited into a Q value of the base mode of the triple-mode cavity resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the outwardly protruding triple-mode cavity resonance structure includes a cavity and a cover plate, wherein the cavity is internally provided with a dielectric resonance block and a dielectric support frame; the cavity takes a cube-like shape and at least one end face protrudes outwards; the dielectric resonance block takes a cube-like shape; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block; when a ratio K of the size of a single side of the inner wall of the cavity to the size of a single side of the dielectric resonance block is: when K is greater than or equal to a transition point 1 and is smaller than or equal to a transition point 2, a Q value of a higher-order mode adjacent to a base mode is transited into a Q value of the base mode of the triple-mode cavity resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the outwardly protruding triple-mode cavity resonance structure includes a cavity and a cover plate, wherein the cavity is internally provided with a dielectric resonance block and a dielectric support frame; the cavity takes a cube-like shape and at least one end face protrudes outwards; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block; a ratio K of the size of a single side of the inner wall of the cavity to the size of a single side of the dielectric resonance block is: when K is greater than or equal to a transition point 1 and is smaller than or equal to a transition point 2, a Q value of a higher-order mode, adjacent to a base mode, of the triple-mode dielectric resonance structure is transited into a Q value of the base mode of the triple-mode dielectric resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the dielectric resonance block is of a solid structure or hollow structure, a hollow part of the dielectric resonance block of the hollow structure is filled with air or a nested dielectric resonance block, and a volume of the nested dielectric resonance block is smaller than or equal to a volume of a hollow chamber.

In an exemplary embodiment of the disclosure, the nested dielectric resonance block takes a cube-like shape and at least one end face protrudes outwards.

In an exemplary embodiment of the disclosure, a film medium is arranged on at least one end face of the nested dielectric resonance block.

In an exemplary embodiment of the disclosure, a film medium is arranged on at least one end face of the cavity or/and at least one end face of the dielectric resonance block.

In an exemplary embodiment of the disclosure, a value of the transition point 1 and a K value of the transition point 2 both vary according to different base-mode resonance frequencies of the dielectric resonance block, dielectric constants of the dielectric resonance block and dielectric constants of the support frame.

In an exemplary embodiment of the disclosure, when the base-mode resonance frequency of the dielectric resonance block after transition remains unchanged, the Q value of the triple-mode dielectric resonance structure is relevant to the K value, the dielectric constant of the dielectric resonance block and the size of the dielectric resonance block.

In an exemplary embodiment of the disclosure, when the K value is increased to the maximum from 1.0, the K value has three Q value transition points within a variation range, each Q value transition point enables the Q value of the base mode of the K value and the Q value of the higher-order mode adjacent to the base mode of the K value to be transited; when the Q value of the base mode is lower than the Q value of the higher-order mode adjacent to the base mode, the Q value of the higher-order mode adjacent to the base mode is transited into the Q value of the base mode, and the Q value of the base mode is higher than that prior to transition; and when the Q value of the base mode is higher than the Q value of the higher-order mode adjacent to the base mode, the Q value of the higher-order mode adjacent to the base mode is transited into the Q value of the base mode, and the Q value of the base mode is lower than that prior to transition.

In an exemplary embodiment of the disclosure, in four areas formed by a start point and a final point of the K value and the three value Q transition points, the Q value of the base mode and the Q value of the higher-order mode adjacent to the base mode vary along with variation of cavity sizes and dielectric resonance rod sizes, and different areas have different requirements when being applied to a filter.

In an exemplary embodiment of the disclosure, the value of the transition point 1 is greater than or equal to 1.03 and smaller than or equal to 1.30, the value of the transition point 2 is greater than or equal to 1.03 and smaller than or equal to 1.30, and the value of the transition point 1 is smaller than the value of the transition point 2.

In an exemplary embodiment of the disclosure, the coupling structure is arranged on the dielectric resonance block, and the coupling structure at least includes two nonparallel arranged holes and/or grooves and/or cut corners and/or chamfers.

In an exemplary embodiment of the disclosure, the grooves or the cut corners or the chamfers are arranged on edges of the dielectric resonance block.

In an exemplary embodiment of the disclosure, the holes or grooves are arranged on an end face of the dielectric resonance block, central lines of the holes or grooves are parallel to edges of end faces in which holes or grooves are formed perpendicularly to the dielectric resonance block.

In an exemplary embodiment of the disclosure, the coupling structure is arranged on the cavity, and the coupling structure at least includes two nonparallel arranged chamfers and/or bosses arranged at inner corners of the cavity and/or tapping lines/pieces arranged in the cavity and do not contact with the dielectric resonance block.

In an exemplary embodiment of the disclosure, a frequency tuning device includes a tuning screw arranged on the cavity and/or a film arranged on the surface of the dielectric resonance block and/or a film arranged on the inner wall of the cavity and/or a film arranged on the inner wall of the cover plate.

In an exemplary embodiment of the disclosure, at least one dielectric support frame is arranged on at least one end face of the dielectric resonance block.

The disclosure also discloses a filter with the outwardly protruding triple-mode cavity resonance structure. The filter includes a cavity, a cover plate and an input/output structure, and the cavity is at least internally provided with one outwardly protruding triple-mode cavity resonance structure.

In an exemplary embodiment of the disclosure, the outwardly protruding triple-mode cavity resonance structure is combined with a single-mode resonance structure, a dual-mode resonance structure and a triple-mode resonance structure in different modes to form filters of different volumes; a coupling of any two resonance cavities formed by permutation and combination of the outwardly protruding triple-mode dielectric resonance structure and any one of the single-mode resonance structure, the dual-mode resonance structure and the triple-mode resonance structure is achieved through a size of a window between the two resonance cavities necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

In an exemplary embodiment of the disclosure, when a resonance frequency of the outwardly protruding triple-mode cavity resonance structure is maintained, a triple-mode Q value is relevant to the ratio K of the side length of the inner wall of the cavity to the side length of the dielectric resonance block, the dielectric constant of the dielectric resonance block and a size variation range of the dielectric resonance block, and the range of the K value is relevant to different resonance frequencies and dielectric constants of the dielectric resonance rod and the dielectric support frame.

In the above technical solution, the variation range of the ratio K of the side length of the inner wall of the cavity in the outwardly protruding triple-mode cavity resonance structure to the size of the dielectric resonance block is that when the K value is increased to the maximum from 1.0, the K value has three Q value transition points within the variation range, each transition point enables the Q value of the base-mode resonance frequency to be transited into the Q value of an adjacent higher-order mode resonance frequency, and when an adjacent Q value of the higher-order mode is transited into the Q value of the base mode, the Q value of the base mode and the Q value of the higher-order mode are increased when being compared with that prior to transition (i.e. both the Q value of the base mode and the Q value of the higher-order mode increase with increasing the K value).

In an exemplary embodiment, in four areas formed by the start point and the final point of the K value and the three value Q transition points, the Q value of the base mode and the adjacent Q value of the higher-order mode gradually vary along with variation of cavity sizes and dielectric resonance rod sizes, and different areas have different requirements when being applied to the filter (application in different areas is explained in the description and examples).

In an exemplary embodiment, the dielectric resonance block of the disclosure is of a solid structure of a cube-like shape, the cube-like shape is defined as that the dielectric resonance block is a cuboid or cube, when the dielectric resonance block has a same size in X, Y and Z axes, a degenerate triple mode is formed, and the degenerate triple-mode is coupled with other single cavities to form a passband filter; when differences of sizes in three directions along the X, Y and Z axes are slightly unequal, orthogonal-like triple-mode resonance is formed, if an orthogonal-like triple-mode is capable of coupling with other cavities into the passband filter, the sizes are acceptable, and if the orthogonal-like triple-mode cannot be coupled with other cavities into the passband filter, the sizes are unacceptable; and when the differences of the sizes in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

In an exemplary embodiment, the outwardly protruding triple-mode cavity resonance structure is internally provided with at least two nonparallel arranged coupling devices for changing orthogonal properties of a degenerate triple-mode electromagnetic field in the cavity, each of the coupling devices includes cut corners and/or holes arranged beside edges of the dielectric resonance block, or includes chamfers and/or cut corners arranged beside the edges of the cavity, or includes cut corners and/or holes arranged beside the edges of the dielectric resonance block, and chamfers/cut corners arranged besides the edges of the cavity, or includes tapping lines or/pieces arranged on nonparallel planes in the cavity, the cut corners take a shape of a triangular prism, a cuboid or a sector, the holes take a shape of a circle, a rectangle or a polygon. After corner cutting or hole formation, in case of frequency holding, side lengths of the dielectric resonance block are increased, and the Q value is slightly decreased; depths of the cut corners or holes are of through or partial cut corners/partial hole structures according to required coupling amounts; the coupling amounts are affected by the sizes of the cut corners/chamfers/holes; a coupling tuning structure includes a coupling screw arranged in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium discs with metallic discs and medium rods with medium discs.

In an exemplary embodiment, the outwardly protruding triple-mode cavity resonance structure forms the degenerate triple-mode in directions along the X, Y and Z axes, and a resonance frequency of the degenerate triple-mode in the direction of an X axis is achieved by additionally installing a tuning screw or a tuning disc at a place with concentrated field intensity on one or two faces of the X axis corresponding to the cavity so as to change a distance or change capacitance; a resonance frequency in the direction of a Y axis is achieved by additionally installing a tuning screw or a tuning disc at a place with concentrated field intensity on one or two faces of the Y axis corresponding to the cavity so as to change a distance or change capacitance; a resonance frequency in the direction of a Z axis is achieved by additionally installing a tuning screw or a tuning disc at a place with concentrated field intensity on one or two faces of the Z axis corresponding to the cavity so as to change a distance or change capacitance; dielectric constant films of different shapes and thicknesses are adhered to a surface of the dielectric resonance block, the inner wall of the cavity or cover plate and the bottom of the tuning screw, and the films are made of a ceramic medium or a ferroelectric material, and frequencies are adjusted by changing dielectric constants; the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium: the tuning screw takes a shape of any one of metallic rods, medium rods, metallic discs, medium discs, metallic rods with metallic discs, metallic rods with medium discs, medium discs with metallic discs and medium rods with medium discs; a frequency temperature coefficient of the dielectric resonance block that takes the cube-like shape is controlled by adjusting proportions of medium materials, and is compensated according to frequency deviation variation of the filter at different temperatures; and when the dielectric support frame is fixed with the inner wall of the cavity, in order to avoid stress caused by the cavity and the medium materials in a sudden temperature variation environment, an elastomer for transition is adopted therebetween, so that reliability risks caused by expansion coefficients of materials is buffered.

In an exemplary embodiment, the outwardly protruding triple-mode dielectric resonance structure includes the cavity, the dielectric resonance block and the support frame; when the cavity takes the cube-like shape, a single cube-like dielectric resonance block and the dielectric support frame are installed in any one axial direction of the cavity, and a center of the dielectric resonance block coincides with or approaches to a center of the cavity. An approximate air dielectric support frame supports with any one single face of a cube-like dielectric block, or supports with six faces, or supports with different combinations of two different faces, three faces, four faces and five faces, the dielectric support frame on each face is one or more dielectric support frames, and one or more support frames are installed on different faces according to demands. A support frame of which the dielectric constant is greater than a dielectric constant of air and smaller than a dielectric constant of the dielectric resonance block supports with any one single face of the cube-like dielectric block, or supports with six faces, or supports with different combinations of two different faces, three faces, four faces and five faces; a face without the support frame is air; the air face is arbitrarily combined with the dielectric support frame; the dielectric support frame on each face is one or more dielectric support frames, or is a complex dielectric constant support frame composed of multiple layers of different dielectric constant medium materials; single-layer and multi-layer medium material support frames are arbitrarily combined with cube-like medium blocks; one or more support frames are installed on different faces according to demands; on faces with the support frames, to hold the triple-mode frequencies and the Q value, the size corresponding to the axial direction of the dielectric resonance block of the dielectric support frame is slightly reduced; a single face support combination supports any one face of the dielectric resonance block, and particularly an under surface or bearing surface in a vertical direction; a support combination of two faces includes parallel faces such as upper and lower faces, front and rear faces and left and right faces, and also includes nonparallel faces such as upper and front faces, upper and rear faces, upper and left faces and upper and right faces; a support combination of three faces includes three faces perpendicular to one another, or two parallel faces and one nonparallel face; a support combination of four faces includes two pairs of parallel faces or a pair of parallel faces and two another nonparallel faces; a support combination of five faces includes support structures of other faces except any one face of a front face/a rear face/a left face/a right face/an upper face/a lower face; and a support combination of six faces includes support structures of all faces of a front face/a rear face/a left face/a right face/an upper face/a lower face.

In an exemplary embodiment, any end of the cube-like dielectric resonance block and the dielectric support frame are connected in a mode of crimping, adhesion or sintering; connection is one face connection or combined connection of different faces; multi-layer dielectric support frames are fixed in modes of adhesion, sintering, crimping and the like; the dielectric support frame and the inner wall of the cavity are connected in a mode of adhesion, crimping, welding, sintering or screw fixation; a radio frequency channel formed by coupling of radio frequency signals in directions of the X, Y and Z axes of the triple mode causes loss and generates heat, the dielectric resonance block is sufficiently connected with the inner wall of the cavity through the dielectric support frame, and thus the heat is conducted into the cavity for heat dissipation.

In an exemplary embodiment, the cube-like dielectric resonance block has a single dielectric constant or composite dielectric constants; the dielectric resonance block with the composite dielectric constants is formed by at least two materials of different dielectric constants; the materials of different dielectric constants are combined up and down, left and right, asymmetrically or in a nested mode; when the materials of different dielectric constants are nested in the dielectric resonance block, one or more layers are nested; and the dielectric resonance block with the composite dielectric constants needs to comply with variation rules of the Q value transition points. When the dielectric resonance block is subjected to cut side coupling among triple modes, to hold the required frequency, corresponding side lengths of two faces adjacent to the cut sides are adjusted. The dielectric resonance block is made of a ceramic or medium material, and medium sheets of different thicknesses and different dielectric constants are added on the surface of the dielectric resonance block.

In an exemplary embodiment, the dielectric constant of the dielectric support frame is similar to the air dielectric constant, or the dielectric constant of the support frame is greater than the air dielectric constant or smaller than the dielectric constant of the dielectric resonance block; the surface area of the dielectric support frame is smaller than or equal to that of the dielectric resonance block; and the dielectric support frame takes a shape of a cylinder, a cube or a cuboid. The dielectric support frame is of a solid structure or hollow structure, the dielectric support frame of the hollow structure includes a single hole or multiple holes, the hole takes a shape of a circle, a square, a polygon and an arc; the dielectric support frame is made of air, plastics, ceramics and mediums; the dielectric support frame is connected with the dielectric resonance block; when the dielectric constant of the dielectric support is similar to the air dielectric constant, the dielectric support has no effect on the three-mode resonant frequency. when the dielectric constant of the dielectric support frame is greater than the air dielectric constant and smaller than the dielectric constant of the dielectric resonance block, in order to hold original triple-mode frequencies, the size corresponding to the axial direction of the dielectric resonance block of the dielectric support frame is slightly reduced; a support frame with a dielectric constant similar to that of air and a support frame with a dielectric constant smaller than that of the dielectric resonance block are combined and installed in different directions and different corresponding faces of the dielectric resonance block; and when the two support frames of different dielectric constants are combined for use, an axial direction size greater than that of a dielectric resonance block corresponding to an air support frame is slightly reduced on an original basis.

In an exemplary embodiment, the cavity takes the cube-like shape; to achieve coupling of three modes, on premise that the size of the dielectric resonance block is not changed, cut sides for achieving coupling of the three modes are processed on any two adjacent faces of the cavity; the sizes of the cut sides are relevant to required coupling amounts; coupling of two of the three modes is achieved through the cut sides of the cube-like; other coupling is achieved through cut corners of two adjacent sides of the cavity; walls are not broken when corners of the adjacent sides of the cavity are cut; and cut corner faces are completely sealed with the cavity. The cavity is made of a metal or a nonmetal material, the surface of the metal and the nonmetal material is electroplated by copper or silver, and when the cavity is made of the nonmetal material, the inner wall of the cavity needs to be electroplated by a conductive material such as copper or silver, such as plastics and composite materials electroplated by copper or silver.

In an exemplary embodiment, the outwardly protruding triple-mode dielectric resonance structure is combined with a single-mode resonance structure, a dual-mode resonance structure and a triple-mode resonance structure in different modes to form filters of different volumes; a coupling of any two resonance cavities formed by permutation and combination of the concave triple-mode dielectric resonance structure and any one of the single-mode resonance structure, the dual-mode resonance structure and the triple-mode resonance structure is achieved through a size of a window between the two resonance cavities necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

The dielectric constant of the cube-like dielectric resonance block of some embodiments in the disclosure is greater than the dielectric constant of the support frame; when the ratio of the size of the single side of the inner wall of the cavity to the size of the single side of the dielectric resonance block is within 1.03-1.30, the Q value of the higher-order mode is transited into the Q value of the base mode, a triple-mode dielectric Q value of the base mode is increased and the Q value of the higher-order mode is decreased, and compared with single mode and triple-mode dielectric filters known to inventors with same volumes and frequencies, the Q value is increased by 30% or greater; the triple-mode cavity structure is combined with single cavities of different types, for example, the triple-mode cavity structure is combined with a cavity single mode, the triple-mode is combined with the TM mode and the triple-mode is combined with the TE single mode, the greater the number of triple-modes in the filter is, the smaller the volume of the filter is, and the smaller the insertion loss is; the outwardly protruding triple-mode cavity resonance structure generates triple-mode resonance in directions of the X, Y and Z axes, and triple-mode resonance is generated in the directions of the X, Y and Z axes.

When the ratio of the side length of the inner wall of the cavity to the size of a corresponding side length of the dielectric resonance block is within 1.0 to the transition point 1 transited from the Q value, and when the ratio of 1.0, the cavity has a pure medium Q value, when the size of the cavity is increased, the Q value is continuously increased on the basis of a pure medium, the Q value of the higher-order mode is greater than the Q value of the base mode, and when the ratio is increased to the transition point 1, an original Q value of the higher-order mode is approximated to a new Q value of the base mode.

After entering into the transition point 1, in case that the base-mode resonance frequency is maintained, the Q value of the base mode is greater than the Q value of the higher-order mode. Along with increase of the ratio, the sizes of the dielectric block and the cavity are both increased, the Q value of the base mode is also increased, and the Q value of the higher-order mode is also increased; when the ratio is approximate to the transition point 2 of Q value transition, the Q value of the base mode is the highest, between the transition point 1 transited from the Q value of the base mode and the transition point 2 transited from the Q value of the base mode, the frequency of the higher-order mode is approximate to or far away from the frequency of the base mode along with variation of the ratio of the cavity to the dielectric resonance block between the transition point 1 and the transition point 2 at times.

After entering the transition point 2, the Q value of the base mode is smaller than the Q value of the higher-order mode; along with increase of the ratio, the size of the dielectric resonance block is reduced, the size of the cavity is increased, the Q value of the base mode is constantly increased, and when the ratio is approximate to a transition point 3, the Q value of the base mode is approximate to the Q value at the transition point 2.

When the ratio enters the transition point 3, the Q value of the base mode is increased along with increase of the ratio, the Q value of the higher-order mode is decreased along with increase of the ratio, the size of the dielectric resonance block is decreased along with increase of the ratio, and the size of the cavity is constantly increased; when the size is approximate to a ¾ wavelength size of the cavity, the size of the dielectric resonance block is constantly decreased, the Q value of the base mode is also decreased, and the frequency of the higher-order mode is approximate to or far away from the frequency of the base mode along with increase of the ratio at times. A particular ratio of the size of the transition points is relevant to dielectric constants and frequencies of the dielectric resonance block and single or composite dielectric constants of the dielectric resonance block.

The side length of the inner wall of the cavity and the side length of the dielectric resonance block may be or may be not equal in three directions of the X, Y and Z axes. The triple mode is formed when the sizes of the cavity and the cube-like dielectric resonance block are equal in the X, Y and Z axes; size differences in three directions of the X, Y and Z axes may also be slightly unequal; when the sizes of single sides of the cavity in one direction of the X, Y and Z axes and the corresponding dielectric resonance block is different from the sizes of single sides in other two directions of the X, Y and Z axes, or any one of the sizes of symmetric single sides of the cavity and the dielectric resonance block are also different from the sizes of single sides in the other two directions, the frequency of one of the triple modes varies and is different from frequencies of the other two modes of the triple modes, and the larger the size difference is, the larger the difference of the frequency of one mode from those of the other two modes is; when the size in one direction is greater than the sizes in the other two directions, the frequency is decreased on an original basis; when the size in one direction is smaller than those in the other two directions, the frequency is increased on the original basis, and the triple mode is gradually transited into a dual-mode or single mode; if the sizes of the cavity and the resonance block in three axial directions are greatly different, and when the sizes of symmetric single sides in three directions of the X, Y and Z axes are different, frequencies of three modes of the triple modes are different; when the sizes of side lengths in three directions are greatly different, the base mode is a single mode; and when the sizes of the side lengths in three directions are not greatly different, the frequencies are not greatly different, and although the frequencies vary, a triple-mode state may also be maintained through the tuning device.

Coupling of triple modes is achieved through at least two nonparallel arranged coupling devices for changing orthogonal properties of the degenerate triple-mode electromagnetic field in the cavity in the outwardly protruding triple-mode cavity resonance structure of the cavity, the coupling devices include cut corners and/or holes arranged beside the edges of the dielectric resonance block, or include chamfers and/or cut corners arranged beside the edges of the cavity, or include cut corners and/or holes arranged beside the edges of the dielectric resonance block, and chamfers/cur corners beside the edges of the cavity, or include tapping lines or/pieces arranged on nonparallel planes in the cavity, the cut corners take the shape of the triangular prism, the cuboid or the sector, the holes take the shape of the circle, the rectangle or the polygon. After corners are cut or holes are formed, in case of frequency maintenance, side lengths of the dielectric resonance block are increased, and the Q value is slightly decreased. Depths of the cut corners or holes are of through or partial cut corners/partial hole structures according to required coupling amounts, and the coupling amounts are affected by the sizes of the cut corners/chamfers/holes. A coupling tuning structure includes a coupling screw disposed in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The resonance frequency of the triple mode in the direction of the X axis is achieved by installing the tuning screw or the tuning disc at the place with concentrated field intensity on one or two faces of the cavity corresponding to the X axis so as to change the distance or change capacitance; the resonance frequency in the direction of the Y axis is achieved by additionally installing the tuning screw or the tuning disc at the place with concentrated field intensity on one or two faces of the Y axis corresponding to the cavity so as to change the distance or change capacitance; and the resonance frequency in the direction of the Z axis is achieved by additionally installing the tuning screw or the tuning disc at the place with concentrated field intensity on one or two faces of the Z axis corresponding to the cavity so as to change the distance or change capacitance.

The triple-mode structure with Q value transition of the dielectric resonant is arbitrarily arranged and combined with the single-mode resonance structure, the dual-mode resonance structure and the triple-mode resonance structure in different modes to form required filters of different sizes; the filter has function properties of band pass, band stop, high pass, low pass and the duplexer, the multiplexer formed between them; and a coupling of any two resonance cavities formed by permutation and combination of the single-mode resonance structure, the dual-mode resonance structure and the triple-mode resonance structure is achieved through the size of the window between the two resonance cavities necessarily when resonance rods in two resonance structures are parallel.

Some embodiments of the disclosure have the beneficial effects that the structure is simple in structure and convenient to use; by setting the ratio of the size of the single side of the inner wall of a metallic cavity of a dielectric triple mode to the size of the single side of the dielectric resonance block within 1.01-1.30, the resonance rod is matched with the cavity to form the triple-mode structure while reverse turning of specific parameters is achieved, and thus a high Q value is ensured when the resonance rod and the cavity are at a small distance apart. Furthermore, some embodiments disclose a filter with the outwardly protruding triple-mode cavity resonance structure, and compared with a triple-mode filter known to inventors, the filter has insertion loss reduced by 30% or greater on premise of same frequencies and same volumes. Dielectric resonant frequency transition triple-mode structures formed by the cube-like dielectric resonance block, the dielectric support frame and the cover plate of the cavity of the disclosure have magnetic fields orthogonal to and perpendicular to one another in directions of the X, Y and Z axes, thus three non-interfering resonance modes are formed, a higher-order mode frequency is transited into a high Q value base-mode frequency, coupling is formed among three magnetic fields, and different bandwidth demands of the filters are met by adjusting coupling intensity. When two filters with the outwardly protruding triple-mode cavity resonance structure are used in a typical 1800 MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to that of the cavity although the dielectric resonance block is used, if the material cost of the dielectric resonance block is greatly reduced, the design may have obvious cost advantages, when the filter has multiple cavities, three triple-mode structure may be used, and volume and performance may be obviously improved.

Furthermore, on premise that the Q value of a single cavity is not greatly decreased, on the basis of the triple-mode resonance structure, a structure of the dielectric resonance block and/or cavity is changed (at least one outwardly protruding end face is provided), so that the tuning range of the tuning screw is increased, meanwhile, the sensitivity to resonance frequencies is reduced due to the small distance between the cavity and the dielectric resonance block, thereby facilitating production debugging and reducing production cost.

Figure 1:
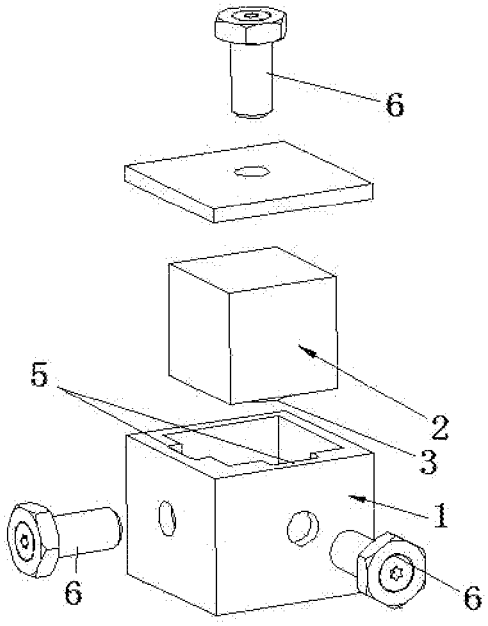
FIG. 1 shows a structural schematic diagram of an outwardly protruding triple-mode cavity resonance structure of an embodiment of the disclosure; a cavity takes a cube-like outwardly protruding shape, and a dielectric resonance block adopts a cube-like shape, and tuning screws are arranged along different axes.

In the figures: 1, cavity; 2, dielectric resonance block; 3, dielectric support frame; 4, nested dielectric block; 5, groove; 6, tuning screw; 7, film medium.

DETAILED DESCRIPTION OF THE EMBODIMENTS

The disclosure discloses an outwardly protruding triple-mode cavity resonance structure which includes a cavity and a cover plate, wherein the cavity is internally provided with a dielectric resonance block and a dielectric support frame; the cavity takes a cube-like shape; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block; when a ratio K of the size of a single side of the inner wall of the cavity to the size of a single side of the dielectric resonance block is: when K is greater than or equal to a transition point 1 and is smaller than or equal to a transition point 2, a Q value of a higher-order mode adjacent to a base mode is transited into a Q value of the base mode of the triple-mode cavity resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the outwardly protruding triple-mode cavity resonance structure includes a cavity and a cover plate, wherein the cavity is internally provided with a dielectric resonance block and a dielectric support frame; the cavity takes a cube-like shape and at least one end face protrudes outwards; the dielectric resonance block takes a cube-like shape; the dielectric support frame is connected with the dielectric resonance block and an inner wall of the cavity, respectively; the dielectric resonance block and the dielectric support frame form a triple-mode dielectric resonance rod: a dielectric constant of the dielectric support frame is smaller than a dielectric constant of the dielectric resonance block; when a ratio K of the size of a single side of the inner wall of the cavity to the size of a single side of the dielectric resonance block is: when K is greater than or equal to a transition point 1 and is smaller than or equal to a transition point 2, a Q value of a higher-order mode adjacent to a base mode is transited into a Q value of the base mode of the triple-mode cavity resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the outwardly protruding triple-mode cavity resonance structure includes a cavity and a cover plate, wherein the cavity is internally provided with a dielectric resonance block and a dielectric support frame; the cavity takes a cube-like shape and at least one end face protrudes outwards; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block; a ratio K of the size of a single side of the inner wall of the cavity to the size of a single side of the dielectric resonance block is: when K is greater than or equal to a transition point 1 and is smaller than or equal to a transition point 2, a Q value of a higher-order mode, adjacent to a base mode, of the triple-mode dielectric resonance structure is transited into a Q value of the base mode of the triple-mode dielectric resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than a Q value of the higher-order mode adjacent to the base mode prior to transition; the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

In an exemplary embodiment of the disclosure, the dielectric resonance block is of a solid structure or hollow structure, a hollow part of the dielectric resonance block of the hollow structure is filled with air or a nested dielectric resonance block, and a volume of the nested dielectric resonance block is smaller than or equal to a volume of a hollow chamber.

In an exemplary embodiment of the disclosure, the nested dielectric resonance block takes a cube-like shape and at least one end face protrudes outwards.

In an exemplary embodiment of the disclosure, a film medium is arranged on at least one end face of the nested dielectric resonance block.

In an exemplary embodiment of the disclosure, a film medium is arranged on at least one end face of the cavity or/and at least one end face of the dielectric resonance block.

In an exemplary embodiment of the disclosure, a value of the transition point 1 and a K value of the transition point 2 both vary according to different base-mode resonance frequencies of the dielectric resonance block, dielectric constants of the dielectric resonance block and dielectric constants of the support frame.

In an exemplary embodiment of the disclosure, when the base-mode resonance frequency of the dielectric resonance block after transition remains unchanged, the Q value of the triple-mode dielectric resonance structure is relevant to the K value, the dielectric constant of the dielectric resonance block and the size of the dielectric resonance block.

In an exemplary embodiment of the disclosure, when the K value is increased to the maximum from 1.0, the K value has three Q value transition points within a variation range, each Q value transition point enables the Q value of the base mode of the K value and the Q value of the higher-order mode adjacent to the base mode of the K value to be transited; when the Q value of the base mode is lower than the Q value of the higher-order mode adjacent to the base mode, the Q value of the higher-order mode adjacent to the base mode is transited into the Q value of the base mode, and the Q value of the base mode is higher than that prior to transition; and when the Q value of the base mode is higher than the Q value of the higher-order mode adjacent to the base mode, the Q value of the higher-order mode adjacent to the base mode is transited into the Q value of the base mode, and the Q value of the base mode is lower than that prior to transition.

In an exemplary embodiment of the disclosure, in four areas formed by a start point and a final point of the K value and the three value Q transition points, the Q value of the base mode and the Q value of the higher-order mode adjacent to the base mode vary along with variation of cavity sizes and dielectric resonance rod sizes, and different areas have different requirements when being applied to a filter.

In an exemplary embodiment of the disclosure, the value of the transition point 1 is greater than or equal to 1.03 and smaller than or equal to 1.30, the value of the transition point 2 is greater than or equal to 1.03 and smaller than or equal to 1.30, and the value of the transition point 1 is smaller than the value of the transition point 2.

In an exemplary embodiment of the disclosure, the coupling structure is arranged on the dielectric resonance block, and the coupling structure at least includes two nonparallel arranged holes and/or grooves and/or cut corners and/or chamfers.

In an exemplary embodiment of the disclosure, the grooves or the cut corners or the chamfers are arranged on edges of the dielectric resonance block.

In an exemplary embodiment of the disclosure, the holes or grooves are arranged on an end face of the dielectric resonance block, central lines of the holes or grooves are parallel to edges of end faces in which holes or grooves are formed perpendicularly to the dielectric resonance block.

In an exemplary embodiment of the disclosure, the coupling structure is arranged on the cavity, and the coupling structure at least includes two nonparallel arranged chamfers and/or bosses arranged at inner corners of the cavity and/or tapping lines/pieces arranged in the cavity and do not contact with the dielectric resonance block.

In an exemplary embodiment of the disclosure, a frequency tuning device includes a tuning screw arranged on the cavity and/or a film arranged on the surface of the dielectric resonance block and/or a film arranged on the inner wall of the cavity and/or a film arranged on the inner wall of the cover plate.

In an exemplary embodiment of the disclosure, at least one dielectric support frame is arranged on at least one end face of the dielectric resonance block.

The disclosure also discloses a filter with the outwardly protruding triple-mode cavity resonance structure. The filter includes a cavity, a cover plate and an input/output structure, and the cavity is at least internally provided with one outwardly protruding triple-mode cavity resonance structure.

In an exemplary embodiment of the disclosure, the outwardly protruding triple-mode cavity resonance structure is combined with a single-mode resonance structure, a dual-mode resonance structure and a triple-mode resonance structure in different modes to form filters of different volumes; a coupling of any two resonance cavities formed by permutation and combination of the outwardly protruding triple-mode dielectric resonance structure and any one of the single-mode resonance structure, the dual-mode resonance structure and the triple-mode resonance structure is achieved through a size of a window between the two resonance cavities necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

In an exemplary embodiment of the disclosure, when a resonance frequency of the outwardly protruding triple-mode cavity resonance structure is maintained, a triple-mode Q value is relevant to the ratio K of the side length of the inner wall of the cavity to the side length of the dielectric resonance block, the dielectric constant of the dielectric resonance block and a size variation range of the dielectric resonance block, and the range of the K value is relevant to different resonance frequencies and dielectric constants of the dielectric resonance rod and the dielectric support frame.

In the above technical solution, the variation range of the ratio K of the side length of the inner wall of the cavity in the outwardly protruding triple-mode cavity resonance structure to the size of the dielectric resonance block is that when the K value is increased to the maximum from 1.0, the K value has three Q value transition points within the variation range, each transition point enables the Q value of the base-mode resonance frequency to be transited into the Q value of an adjacent higher-order mode resonance frequency, and when an adjacent Q value of the higher-order mode is transited into the Q value of the base mode, the Q value of the base mode and the Q value of the higher-order mode are increased when being compared with that prior to transition (i.e. both the Q value of the base mode and the Q value of the higher-order mode increase with increasing the K value).

In an exemplary embodiment, in four areas formed by the start point and the final point of the K value and the three value Q transition points, the Q value of the base mode and the adjacent Q value of the higher-order mode gradually vary along with variation of cavity sizes and dielectric resonance rod sizes, and different areas have different requirements when being applied to the filter (application in different areas is explained in the description and examples).

In an exemplary embodiment, the dielectric resonance block of the disclosure is of a solid structure of a cube-like shape, the cube-like shape is defined as that the dielectric resonance block is a cuboid or cube, when the dielectric resonance block has a same size in X, Y and Z axes, a degenerate triple mode is formed, and the degenerate triple-mode is coupled with other single cavities to form a passband filter; when differences of sizes in three directions along the X, Y and Z axes are slightly unequal, orthogonal-like triple-mode resonance is formed, if an orthogonal-like triple-mode is capable of coupling with other cavities into the passband filter, the sizes are acceptable, and if the orthogonal-like triple-mode cannot be coupled with other cavities into the passband filter, the sizes are unacceptable; and when the differences of the sizes in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

In an exemplary embodiment, the outwardly protruding triple-mode cavity resonance structure is internally provided with at least two nonparallel arranged coupling devices for changing orthogonal properties of a degenerate triple-mode electromagnetic field in the cavity, each of the coupling devices includes cut corners and/or holes arranged beside edges of the dielectric resonance block, or includes chamfers and/or cut corners arranged beside the edges of the cavity, or includes cut corners and/or holes arranged beside the edges of the dielectric resonance block, and chamfers/cut corners arranged besides the edges of the cavity, or includes tapping lines or/pieces arranged on nonparallel planes in the cavity, the cut corners take a shape of a triangular prism, a cuboid or a sector, the holes take a shape of a circle, a rectangle or a polygon. After corner cutting or hole formation, in case of frequency holding, side lengths of the dielectric resonance block are increased, and the Q value is slightly decreased; depths of the cut corners or holes are of through or partial cut corners/partial hole structures according to required coupling amounts; the coupling amounts are affected by the sizes of the cut corners/chamfers/holes; a coupling tuning structure includes a coupling screw arranged in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium discs with metallic discs and medium rods with medium discs.

In an exemplary embodiment, the outwardly protruding triple-mode cavity resonance structure forms the degenerate triple-mode in directions along the X, Y and Z axes, and a resonance frequency of the degenerate triple-mode in the direction of an X axis is achieved by additionally installing a tuning screw or a tuning disc at a place with concentrated field intensity on one or two faces of the X axis corresponding to the cavity so as to change a distance or change capacitance; a resonance frequency in the direction of a Y axis is achieved by additionally installing a tuning screw or a tuning disc at a place with concentrated field intensity on one or two faces of the Y axis corresponding to the cavity so as to change a distance or change capacitance; a resonance frequency in the direction of a Z axis is achieved by additionally installing a tuning screw or a tuning disc at a place with concentrated field intensity on one or two faces of the Z axis corresponding to the cavity so as to change a distance or change capacitance; dielectric constant films of different shapes and thicknesses are adhered to a surface of the dielectric resonance block, the inner wall of the cavity or cover plate and the bottom of the tuning screw, and the films are made of a ceramic medium or a ferroelectric material, and frequencies are adjusted by changing dielectric constants; the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium; the tuning screw takes a shape of any one of metallic rods, medium rods, metallic discs, medium discs, metallic rods with metallic discs, metallic rods with medium discs, medium discs with metallic discs and medium rods with medium discs; a frequency temperature coefficient of the dielectric resonance block that takes the cube-like shape is controlled by adjusting proportions of medium materials, and is compensated according to frequency deviation variation of the filter at different temperatures; and when the dielectric support frame is fixed with the inner wall of the cavity, in order to avoid stress caused by the cavity and the medium materials in a sudden temperature variation environment, an elastomer for transition is adopted therebetween, so that reliability risks caused by expansion coefficients of materials is buffered.

In an exemplary embodiment, the outwardly protruding triple-mode dielectric resonance structure includes the cavity, the dielectric resonance block and the support frame; when the cavity takes the cube-like shape, a single cube-like dielectric resonance block and the dielectric support frame are installed in any one axial direction of the cavity, and a center of the dielectric resonance block coincides with or approaches to a center of the cavity. An approximate air dielectric support frame supports with any one single face of a cube-like dielectric block, or supports with six faces, or supports with different combinations of two different faces, three faces, four faces and five faces, the dielectric support frame on each face is one or more dielectric support frames, and one or more support frames are installed on different faces according to demands. A support frame of which the dielectric constant is greater than a dielectric constant of air and smaller than a dielectric constant of the dielectric resonance block supports with any one single face of the cube-like dielectric block, or supports with six faces, or supports with different combinations of two different faces, three faces, four faces and five faces; a face without the support frame is air; the air face is arbitrarily combined with the dielectric support frame; the dielectric support frame on each face is one or more dielectric support frames, or is a complex dielectric constant support frame composed of multiple layers of different dielectric constant medium materials; single-layer and multi-layer medium material support frames are arbitrarily combined with cube-like medium blocks; one or more support frames are installed on different faces according to demands; on faces with the support frames, to hold the triple-mode frequencies and the Q value, the size corresponding to the axial direction of the dielectric resonance block of the dielectric support frame is slightly reduced; a single face support combination supports any one face of the dielectric resonance block, and particularly an under surface or bearing surface in a vertical direction; a support combination of two faces includes parallel faces such as upper and lower faces, front and rear faces and left and right faces, and also includes nonparallel faces such as upper and front faces, upper and rear faces, upper and left faces and upper and right faces; a support combination of three faces includes three faces perpendicular to one another, or two parallel faces and one nonparallel face; a support combination of four faces includes two pairs of parallel faces or a pair of parallel faces and two another nonparallel faces; a support combination of five faces includes support structures of other faces except any one face of a front face/a rear face/a left face/a right face/an upper face/a lower face; and a support combination of six faces includes support structures of all faces of a front face/a rear face/a left face/a right face/an upper face/a lower face.

In an exemplary embodiment, any end of the cube-like dielectric resonance block and the dielectric support frame are connected in a mode of crimping, adhesion or sintering; connection is one face connection or combined connection of different faces; multi-layer dielectric support frames are fixed in modes of adhesion, sintering, crimping and the like; the dielectric support frame and the inner wall of the cavity are connected in a mode of adhesion, crimping, welding, sintering or screw fixation; a radio frequency channel formed by coupling of radio frequency signals in directions of the X, Y and Z axes of the triple mode causes loss and generates heat, the dielectric resonance block is sufficiently connected with the inner wall of the cavity through the dielectric support frame, and thus the heat is conducted into the cavity for heat dissipation.

In an exemplary embodiment, the cube-like dielectric resonance block has a single dielectric constant or composite dielectric constants; the dielectric resonance block with the composite dielectric constants is formed by at least two materials of different dielectric constants; the materials of different dielectric constants are combined up and down, left and right, asymmetrically or in a nested mode; when the materials of different dielectric constants are nested in the dielectric resonance block, one or more layers are nested; and the dielectric resonance block with the composite dielectric constants needs to comply with variation rules of the Q value transition points. When the dielectric resonance block is subjected to cut side coupling among triple modes, to hold the required frequency, corresponding side lengths of two faces adjacent to the cut sides are adjusted. The dielectric resonance block is made of a ceramic or medium material, and medium sheets of different thicknesses and different dielectric constants are added on the surface of the dielectric resonance block.

In an exemplary embodiment, the dielectric constant of the dielectric support frame is similar to the air dielectric constant, or the dielectric constant of the support frame is greater than the air dielectric constant or smaller than the dielectric constant of the dielectric resonance block; the surface area of the dielectric support frame is smaller than or equal to that of the dielectric resonance block; and the dielectric support frame takes a shape of a cylinder, a cube or a cuboid. The dielectric support frame is of a solid structure or hollow structure, the dielectric support frame of the hollow structure includes a single hole or multiple holes, the hole takes a shape of a circle, a square, a polygon and an arc; the dielectric support frame is made of air, plastics, ceramics and mediums; the dielectric support frame is connected with the dielectric resonance block; when the dielectric constant of the dielectric support is similar to the air dielectric constant, the dielectric support has no effect on the three-mode resonant frequency. when the dielectric constant of the dielectric support frame is greater than the air dielectric constant and smaller than the dielectric constant of the dielectric resonance block, in order to hold original triple-mode frequencies, the size corresponding to the axial direction of the dielectric resonance block of the dielectric support frame is slightly reduced; a support frame with a dielectric constant similar to that of air and a support frame with a dielectric constant smaller than that of the dielectric resonance block are combined and installed in different directions and different corresponding faces of the dielectric resonance block; and when the two support frames of different dielectric constants are combined for use, an axial direction size greater than that of a dielectric resonance block corresponding to an air support frame is slightly reduced on an original basis.

In an exemplary embodiment, the cavity takes the cube-like shape; to achieve coupling of three modes, on premise that the size of the dielectric resonance block is not changed, cut sides for achieving coupling of the three modes are processed on any two adjacent faces of the cavity; the sizes of the cut sides are relevant to required coupling amounts; coupling of two of the three modes is achieved through the cut sides of the cube-like; other coupling is achieved through cut corners of two adjacent sides of the cavity; walls are not broken when corners of the adjacent sides of the cavity are cut; and cut corner faces are completely sealed with the cavity. The cavity is made of a metal or a nonmetal material, the surface of the metal and the nonmetal material is electroplated by copper or silver, and when the cavity is made of the nonmetal material, the inner wall of the cavity needs to be electroplated by a conductive material such as copper or silver, such as plastics and composite materials electroplated by copper or silver.

In an exemplary embodiment, the outwardly protruding triple-mode dielectric resonance structure is combined with a single-mode resonance structure, a dual-mode resonance structure and a triple-mode resonance structure in different modes to form filters of different volumes; a coupling of any two resonance cavities formed by permutation and combination of the concave triple-mode dielectric resonance structure and any one of the single-mode resonance structure, the dual-mode resonance structure and the triple-mode resonance structure is achieved through a size of a window between the two resonance cavities necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

The dielectric constant of the cube-like dielectric resonance block of some embodiments in the disclosure is greater than the dielectric constant of the support frame; when the ratio of the size of the single side of the inner wall of the cavity to the size of the single side of the dielectric resonance block is within 1.03-1.30, the Q value of the higher-order mode is transited into the Q value of the base mode, a triple-mode dielectric Q value of the base mode is increased and the Q value of the higher-order mode is decreased, and compared with single mode and triple-mode dielectric filters known to inventors with same volumes and frequencies, the Q value is increased by 30% or greater; the triple-mode cavity structure is combined with single cavities of different types, for example, the triple-mode cavity structure is combined with a cavity single mode, the triple-mode is combined with the TM mode and the triple-mode is combined with the TE single mode, the greater the number of triple-modes in the filter is, the smaller the volume of the filter is, and the smaller the insertion loss is; the outwardly protruding triple-mode cavity resonance structure generates triple-mode resonance in directions of the X, Y and Z axes, and triple-mode resonance is generated in the directions of the X, Y and Z axes.

When the ratio of the side length of the inner wall of the cavity to the size of a corresponding side length of the dielectric resonance block is within 1.0 to the transition point 1 transited from the Q value, and when the ratio of 1.0, the cavity has a pure medium Q value, when the size of the cavity is increased, the Q value is continuously increased on the basis of a pure medium, the Q value of the higher-order mode is greater than the Q value of the base mode, and when the ratio is increased to the transition point 1, an original Q value of the higher-order mode is approximated to a new Q value of the base mode.

After entering into the transition point 1, in case that the base-mode resonance frequency is maintained, the Q value of the base mode is greater than the Q value of the higher-order mode. Along with increase of the ratio, the sizes of the dielectric block and the cavity are both increased, the Q value of the base mode is also increased, and the Q value of the higher-order mode is also increased; when the ratio is approximate to the transition point 2 of Q value transition, the Q value of the base mode is the highest, between the transition point 1 transited from the Q value of the base mode and the transition point 2 transited from the Q value of the base mode, the frequency of the higher-order mode is approximate to or far away from the frequency of the base mode along with variation of the ratio of the cavity to the dielectric resonance block between the transition point 1 and the transition point 2 at times.

After entering the transition point 2, the Q value of the base mode is smaller than the Q value of the higher-order mode; along with increase of the ratio, the size of the dielectric resonance block is reduced, the size of the cavity is increased, the Q value of the base mode is constantly increased, and when the ratio is approximate to a transition point 3, the Q value of the base mode is approximate to the Q value at the transition point 2.

When the ratio enters the transition point 3, the Q value of the base mode is increased along with increase of the ratio, the Q value of the higher-order mode is decreased along with increase of the ratio, the size of the dielectric resonance block is decreased along with increase of the ratio, and the size of the cavity is constantly increased; when the size is approximate to a ¾ wavelength size of the cavity, the size of the dielectric resonance block is constantly decreased, the Q value of the base mode is also decreased, and the frequency of the higher-order mode is approximate to or far away from the frequency of the base mode along with increase of the ratio at times. A particular ratio of the size of the transition points is relevant to dielectric constants and frequencies of the dielectric resonance block and single or composite dielectric constants of the dielectric resonance block.

The side length of the inner wall of the cavity and the side length of the dielectric resonance block may be or may be not equal in three directions of the X, Y and Z axes. The triple mode is formed when the sizes of the cavity and the cube-like dielectric resonance block are equal in the X, Y and Z axes; size differences in three directions of the X, Y and Z axes may also be slightly unequal; when the sizes of single sides of the cavity in one direction of the X, Y and Z axes and the corresponding dielectric resonance block is different from the sizes of single sides in other two directions of the X, Y and Z axes, or any one of the sizes of symmetric single sides of the cavity and the dielectric resonance block are also different from the sizes of single sides in the other two directions, the frequency of one of the triple modes varies and is different from frequencies of the other two modes of the triple modes, and the larger the size difference is, the larger the difference of the frequency of one mode from those of the other two modes is; when the size in one direction is greater than the sizes in the other two directions, the frequency is decreased on an original basis; when the size in one direction is smaller than those in the other two directions, the frequency is increased on the original basis, and the triple mode is gradually transited into a dual-mode or single mode; if the sizes of the cavity and the resonance block in three axial directions are greatly different, and when the sizes of symmetric single sides in three directions of the X, Y and Z axes are different, frequencies of three modes of the triple modes are different; when the sizes of side lengths in three directions are greatly different, the base mode is a single mode; and when the sizes of the side lengths in three directions are not greatly different, the frequencies are not greatly different, and although the frequencies vary, a triple-mode state may also be maintained through the tuning device.

Coupling of triple modes is achieved through at least two nonparallel arranged coupling devices for changing orthogonal properties of the degenerate triple-mode electromagnetic field in the cavity in the outwardly protruding triple-mode cavity resonance structure of the cavity, the coupling devices include cut corners and/or holes arranged beside the edges of the dielectric resonance block, or include chamfers and/or cut corners arranged beside the edges of the cavity, or include cut corners and/or holes arranged beside the edges of the dielectric resonance block, and chamfers/cur corners beside the edges of the cavity, or include tapping lines or/pieces arranged on nonparallel planes in the cavity, the cut corners take the shape of the triangular prism, the cuboid or the sector, the holes take the shape of the circle, the rectangle or the polygon. After corners are cut or holes are formed, in case of frequency maintenance, side lengths of the dielectric resonance block are increased, and the Q value is slightly decreased. Depths of the cut corners or holes are of through or partial cut corners/partial hole structures according to required coupling amounts, and the coupling amounts are affected by the sizes of the cut corners/chamfers/holes. A coupling tuning structure includes a coupling screw disposed in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The resonance frequency of the triple mode in the direction of the X axis is achieved by installing the tuning screw or the tuning disc at the place with concentrated field intensity on one or two faces of the cavity corresponding to the X axis so as to change the distance or change capacitance; the resonance frequency in the direction of the Y axis is achieved by additionally installing the tuning screw or the tuning disc at the place with concentrated field intensity on one or two faces of the Y axis corresponding to the cavity so as to change the distance or change capacitance; and the resonance frequency in the direction of the Z axis is achieved by additionally installing the tuning screw or the tuning disc at the place with concentrated field intensity on one or two faces of the Z axis corresponding to the cavity so as to change the distance or change capacitance.

The triple-mode structure with Q value transition of the dielectric resonant is arbitrarily arranged and combined with the single-mode resonance structure, the dual-mode resonance structure and the triple-mode resonance structure in different modes to form required filters of different sizes; the filter has function properties of band pass, band stop, high pass, low pass and the duplexer, the multiplexer formed between them; and a coupling of any two resonance cavities formed by permutation and combination of the single-mode resonance structure, the dual-mode resonance structure and the triple-mode resonance structure is achieved through the size of the window between the two resonance cavities necessarily when resonance rods in two resonance structures are parallel.

Some embodiments of the disclosure have the beneficial effects that the structure is simple in structure and convenient to use; by setting the ratio of the size of the single side of the inner wall of a metallic cavity of a dielectric triple mode to the size of the single side of the dielectric resonance block within 1.01-1.30, the resonance rod is matched with the cavity to form the triple-mode structure while reverse turning of specific parameters is achieved, and thus a high Q value is ensured when the resonance rod and the cavity are at a small distance apart. Furthermore, some embodiments disclose a filter with the outwardly protruding triple-mode cavity resonance structure, and compared with a triple-mode filter known to inventors, the filter has insertion loss reduced by 30% or greater on premise of same frequencies and same volumes. Dielectric resonant frequency transition triple-mode structures formed by the cube-like dielectric resonance block, the dielectric support frame and the cover plate of the cavity of the disclosure have magnetic fields orthogonal to and perpendicular to one another in directions of the X, Y and Z axes, thus three non-interfering resonance modes are formed, a higher-order mode frequency is transited into a high Q value base-mode frequency, coupling is formed among three magnetic fields, and different bandwidth demands of the filters are met by adjusting coupling intensity. When two filters with the outwardly protruding triple-mode cavity resonance structure are used in a typical 1800

MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to that of the cavity although the dielectric resonance block is used, if the material cost of the dielectric resonance block is greatly reduced, the design may have obvious cost advantages, when the filter has multiple cavities, three triple-mode structure may be used, and volume and performance may be obviously improved. Furthermore, on premise that the Q value of a single cavity is not greatly decreased, on the basis of the triple-mode resonance structure, a structure of the dielectric resonance block and/or cavity is changed (at least one outwardly protruding end face is provided), so that the tuning range of the tuning screw is increased, meanwhile, the sensitivity to resonance frequencies is reduced due to the small distance between the cavity and the dielectric resonance block, thereby facilitating production debugging and reducing production cost.

The high-Q triple-mode dielectric resonance structure has significant advantages in terms of volume. Furthermore, in the case where the single cavity volume is small, the Q value of the cavity high-Q multimode dielectric resonance structure is significantly higher than the Q value of the other forms of single cavity. With the high-Q triple-mode dielectric resonance structure, a volume of the filter is reduced by more than 30%. Meanwhile, the loss of the filter is reduced by 30%, and when the performance of the high-Q triple-mode dielectric resonance structure filter is the same as that of the conventional filter, the volume is significantly reduced by more than 50% relative to a conventional cavity filter.

An outwardly protruding multi-mode cavity resonance structure described in following embodiments includes:

a cavity taking a cube-like shape, a dielectric resonance block protruding outwards, and a dielectric support frame;

a cavity protruding outwards, a dielectric resonance block taking a cube-like shape, and a dielectric support frame;

a cavity and a dielectric resonance block both protruding outwards, and a dielectric support frame; and the dielectric support frame is manufactured in match with a structure, and the number may be one or more. Shapes may be regular shapes such as solid/hollow cylinders, solid/hollow square columns, or may also be irregular shapes, or are composed of multiple columns.

In order to ensure multiple modes and corresponding frequencies, the structure is not infinitely protrude outwards but is subjected to limitation conditions. An example is taken for explanation, and others can be similarly obtained.

Eg: single cavity 26 mm*26 mm*26 mm, the dielectric support frame is Er9.8, Q*f is 100,000, an outer diameter is 5 mm, an inner diameter is 9.7 mm, the dielectric resonance rod is Er43, and Q*f is 43,000.

Apparently, the longest side length 25.97 of the dielectric resonance block is already approximate to a side length 26 mm of the cavity, therefore, the outwardly protruding size is 1.5 mm at most.

To understand the disclosure clearly, the disclosure is specifically described with specific embodiments and figures, and the description does not constitute any limitation to the disclosure.

Figure 2:
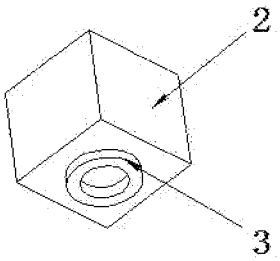
FIG. 2 shows a schematic diagram of a dielectric resonance block and a dielectric support frame of an outwardly protruding triple-mode cavity resonance structure of an embodiment of the disclosure.

As shown in FIG. 1 and FIG. 2, a multi-mode resonance structure of some embodiments of the disclosure includes a cavity 1, wherein the cavity 1 is internally provided with a dielectric resonance block 2 and a dielectric support frame 3. The dielectric resonance block 2 takes a cube-like shape; the cavity 1 takes a cube-like shape and one or more nonparallel end faces protrude outwards; an outwardly protruding part of the cavity 1 is formed by partially forming grooves 5 in one or more nonparallel end faces of an inner wall of the cavity; one end face of the dielectric resonance block 2 is connected with the inner wall 1 of the cavity through the dielectric support frame 3 respectively; tuning screws 6 are arranged on a cover plate and the cavity; and three tuning screws 6 are arranged in a mutual perpendicular manner in pairs.

Figure 3:
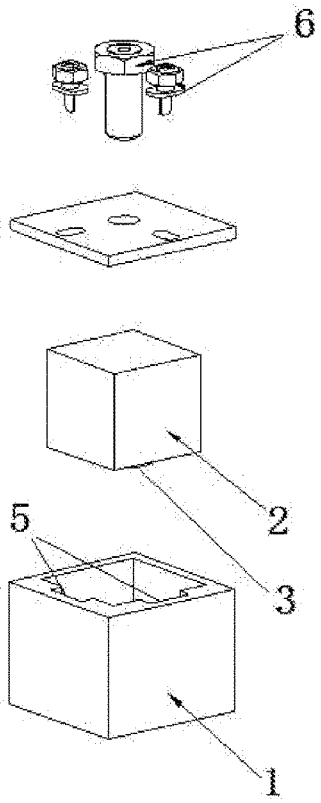
FIG. 3 shows a structural schematic diagram of an outwardly protruding triple-mode cavity resonance structure of an embodiment of the disclosure; wherein a cavity takes a cube-like outwardly protruding shape, and a dielectric resonance block takes a cube-like shape; the tuning screws are arranged on a plane (cover plate), to facilitate cavity arrangement.
Figure 4:
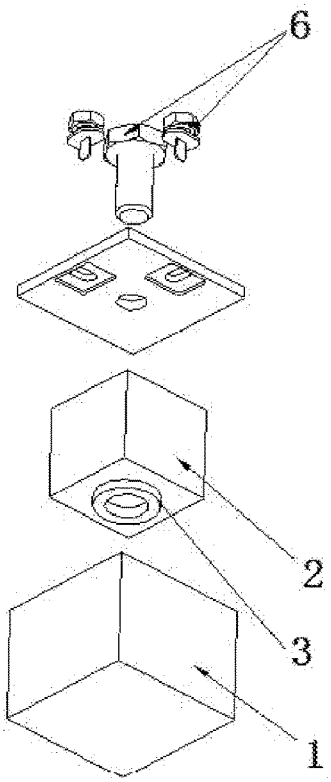
FIG. 4 shows a bottom view of FIG. 3.

As shown in FIG. 3 and FIG. 4, a multi-mode resonance structure of an embodiment of the disclosure includes a cavity 1, wherein the cavity 1 is internally provided with a dielectric resonance block 2 and a dielectric support frame 3; the dielectric resonance block 2 takes a cube-like shape; the cavity 1 takes a cube-like shape and one or more nonparallel end faces protrude outwards; an outwardly protruding part of the cavity 1 is formed by partially forming blind holes 5 in one or more nonparallel end faces of an inner wall of the cavity. An end face of the dielectric resonance block 2 is connected with an inner wall of the cavity 1 through the dielectric support frame 3 respectively; three tuning screws 6 are arranged on a cover plate and the cavity; and the three tuning screws 6 are arranged in a mutual perpendicular manner in pairs.

Figure 5:
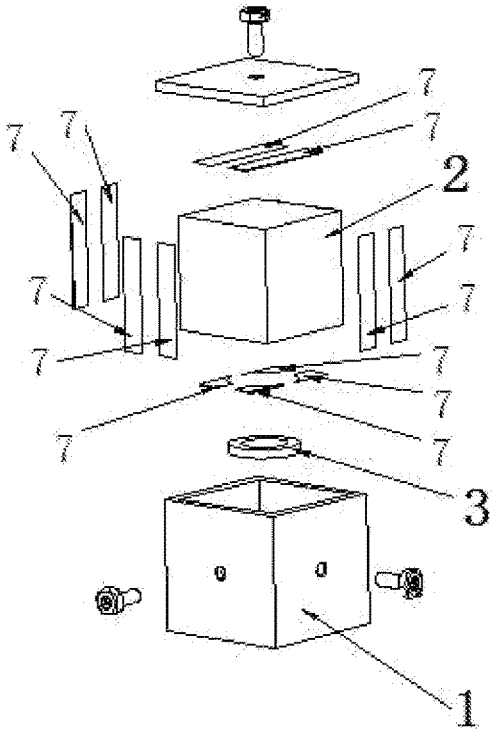
FIG. 5 shows an outwardly protruding triple-mode cavity resonance structure of another embodiment of the disclosure, wherein a cavity takes a cube-like shape, and a dielectric resonance block takes a cube-like shape added with thin mediums on end faces.

As shown in FIG. 5, a multi-mode resonance structure of another embodiment of the disclosure includes a cavity 1, wherein the cavity 1 is internally provided with a dielectric resonance block 2 and a dielectric support frame 3; the cavity 1 takes a cube-like shape; the dielectric resonance block 2 takes a cube-like shape; and medium films 7 are adhered to six end faces of the dielectric resonance block 2.

Figure 6:
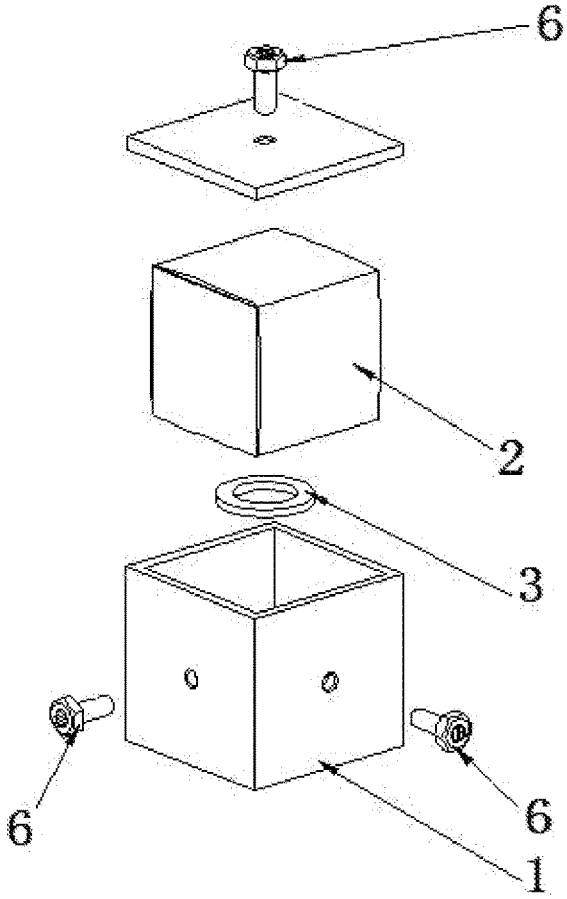
FIG. 6 shows another outwardly protruding triple-mode cavity resonance structure of an embodiment of the disclosure; a cavity takes a cube-like shape, and an end face of the dielectric resonance block protrudes outwards in a curved surface manner.

As shown in FIG. 6, a multi-mode resonance structure of an embodiment of the disclosure includes a cavity 1, wherein the cavity 1 is internally provided with a dielectric resonance block 2 and a dielectric support frame 3; the dielectric resonance block 2 takes a cube-like shape and one or more nonparallel end faces are formed through outward protruding; the cavity 1 takes a cube-like shape. One end face of the dielectric resonance block 2 is connected with an inner wall of the cavity 1 through the dielectric support frame 3 respectively; and tuning screw holes are formed in nonparallel surfaces of the cavity 2.

Figure 7:
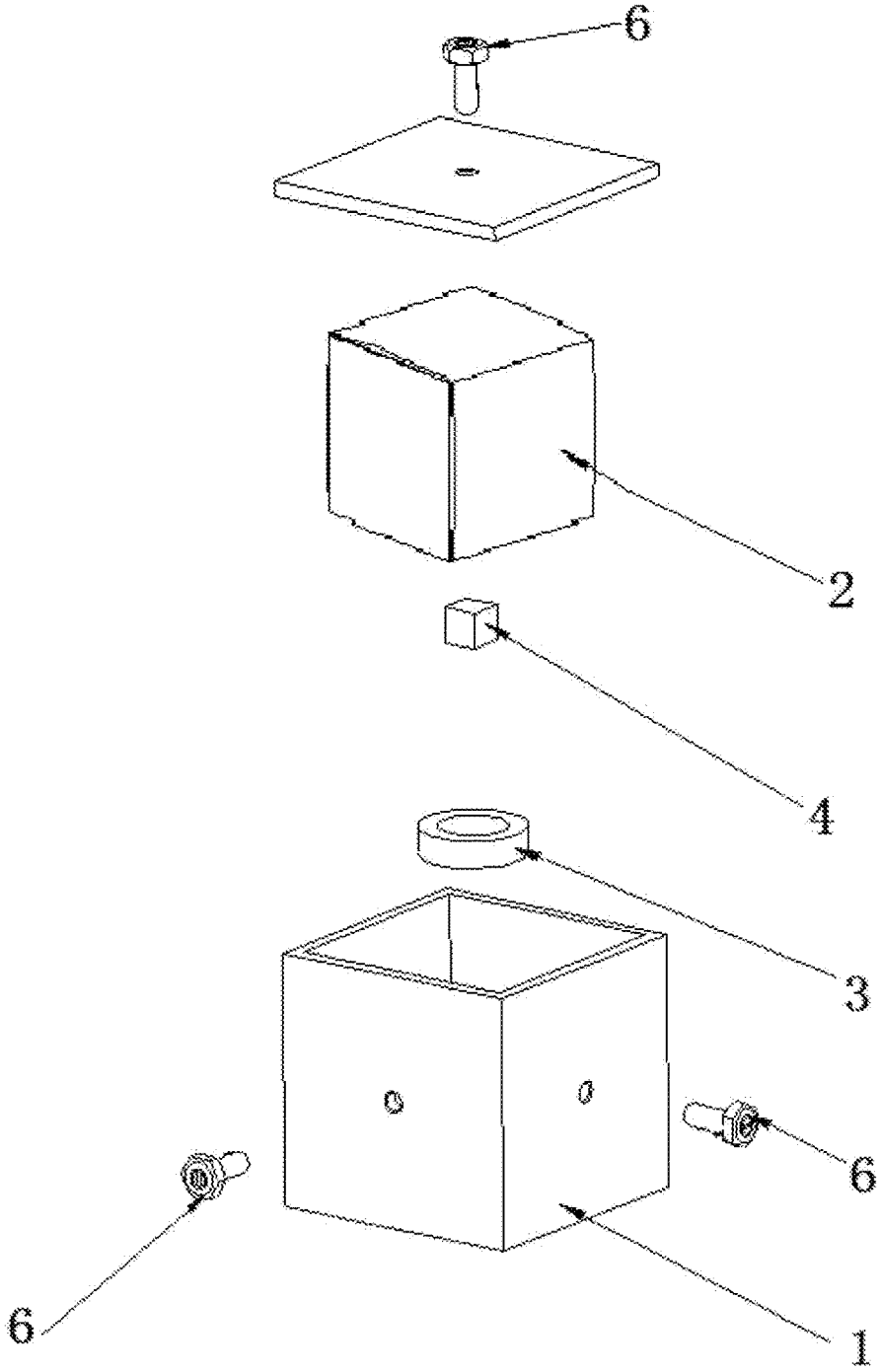
FIG. 7 shows an outwardly protruding triple-mode cavity resonance structure of another embodiment of the disclosure; wherein a cavity takes a cube-like shape, and an end face of the dielectric resonance block protrudes outwards in a curved surface manner after a center is partially hollowed.
Figure 8:
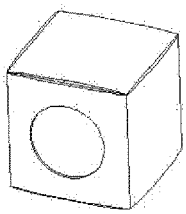
FIG. 8 shows an amplified schematic diagram of an outwardly protruding dielectric resonance block of FIG. 7.

As shown in FIG. 7, a multi-mode resonance structure of an embodiment of the disclosure includes a cavity 1, wherein the cavity 1 is internally provided with a dielectric resonance block 2 and a dielectric support frame 3; the dielectric resonance block 2 takes a cube-like shape and one or more nonparallel end faces are formed through outward protruding; the dielectric resonance block 2 is of a hollow structure; a hollow part is filled with a nested dielectric resonance block 4; the cavity 1 takes a cube-like shape; one end face of the dielectric resonance block 2 is connected with an inner wall of the cavity 1 through the dielectric support frame 3 respectively; and tuning screw holes are formed in nonparallel surfaces of the cavity 2.

The above embodiments are only some embodiments of the disclosure and do not constitute any limitation to the disclosure, particularly shapes and numbers of the dielectric support frames.

For example, in embodiments 1-5, directions of three edges perpendicular to one another in the dielectric resonance block 2 are respectively defined as an X direction, a Y direction and a Z direction, the three directions are relative position directions and are not solely determined. The dielectric resonance block 2 forms an X-axis dielectric resonance rod, a Y-axis dielectric resonance rod, and a Z-axis dielectric resonance rod, with corresponding dielectric support frames in the three X, Y and Z directions. The X-axis dielectric resonance rod, the Y-axis dielectric resonance rod and the Z-axis dielectric resonance rod are matched with an interior of the cavity to form three degenerate modes. A resonance frequency in the direction of the X axis can be achieved by additionally installing a tuning screw on a side wall corresponding to a metallic cavity to change a distance or change capacitance. A resonance frequency in the direction of the Y axis can be achieved by additionally installing a tuning screw on a side wall corresponding to a metallic cavity to change a distance or change capacitance. A resonance frequency in the direction of the Z axis can be achieved by additionally installing a tuning screw on a side wall corresponding to a metallic cavity to change a distance or change capacitance.

A radio frequency signal has loss after triple-mode resonance. Heat is generated when three degenerate modes in X, Y and Z directions in working, heat conduction can be achieved by enabling the dielectric resonance block and multiple dielectric support frames to sufficiently contact with walls of the metallic cavity, and thus a filter can work stably for a long time.

Figure 9:
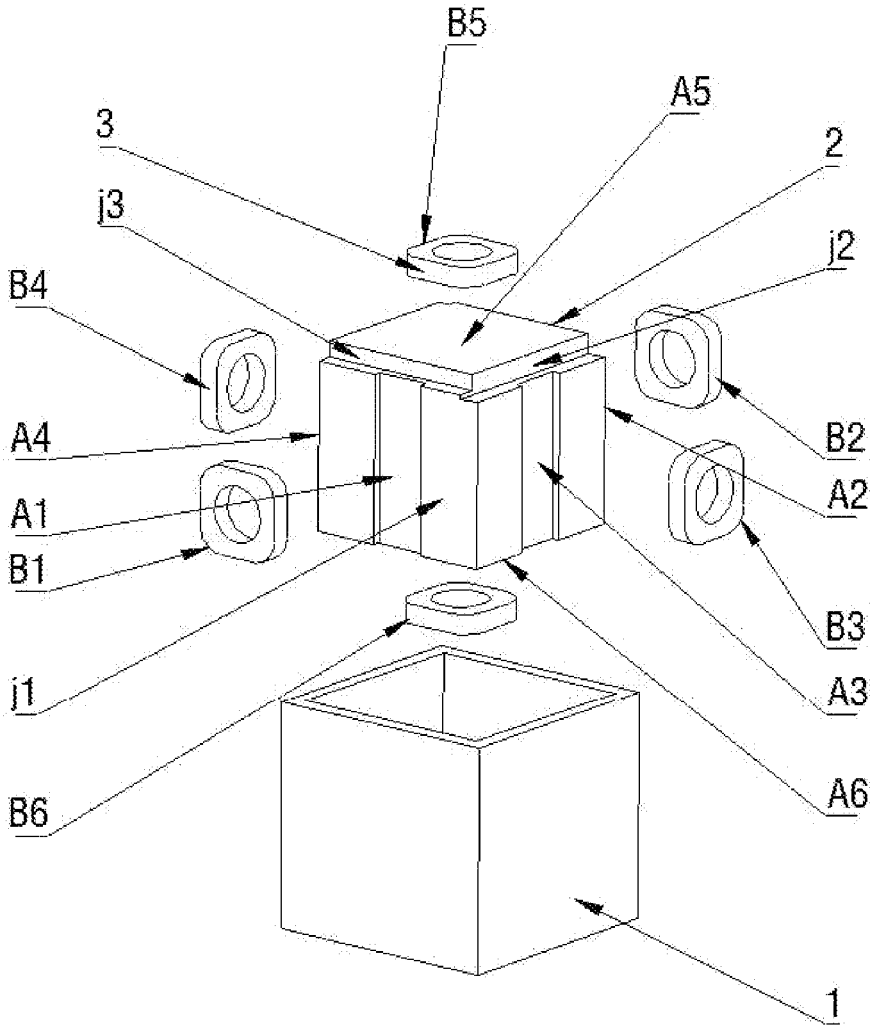
FIG. 9 shows a schematic diagram of an outwardly protruding triple-mode cavity resonance structure.

Coupling devices are arranged between every two of the three degenerate modes, as shown in FIG. 9 particularly: the dielectric resonance block 2 is provided with a first plane j1 for coupling resonance modes in the X direction and the Y direction, a second plane j2 for coupling resonance modes in the Y direction and the Z direction, and a third plane j3 for coupling resonance modes in the X direction and the Z direction. Every two of the first plane j1, the second plane j2 and the third plane j3 are respectively perpendicular to each other. The first plane j1 is parallel to an edge arranged along the Z direction, the second plane j2 is parallel to an edge arranged along the X direction, and the third plane is parallel to an edge arranged along the Y direction. That is, in the three degenerate modes, coupling of a degenerate mode in the X direction with a degenerate mode in the Y direction is achieved by the first plane j1 which is formed by cutting off a part of a corner along the direction of the Z axis, and the corner is formed by cross X and Y planes of a dielectric resonance block A. Coupling of a degenerate mode in the X direction with a degenerate mode in the Z direction is achieved by the second plane j2 which is formed by cutting off a part of a corner along the direction of the X axis and the corner is formed by cross Y and Z planes of a dielectric resonance block. Coupling of a degenerate mode in the Y direction with a degenerate mode in the Z direction is achieved by the third plane j3 which is formed by cutting off a part of a corner along the direction of the Y axis and the corner is formed by cross Z and X planes of a dielectric resonance block. The larger the area of a coupling surface is, the larger the coupling amount is, and the smaller the coupling amount is otherwise. Transmission zero points may be formed by cross coupling of three degenerate modes formed by the dielectric resonance block. If coupling of an X direction resonance mode and a Y direction resonance mode and coupling of a Y direction resonance mode and a Z direction resonance mode are main coupling, coupling of the X direction resonance mode and the Z direction resonance mode is cross coupling.

In the above solution, according to actual coupling amounts, one or more first planes j1 are arranged. When more first planes j1 are arranged, the more first planes j1 are arranged in parallel. One or more second planes j2 are arranged. When more second planes j2 are arranged, the more second planes j2 are arranged in parallel. One or more third planes j3 are arranged. When more third planes j3 are arranged, the more third planes j3 are arranged in parallel.

In the above solution, the dielectric resonance block 2 is directly formed by a cube-like shape with approximate side lengths or by a cube medium with equal side lengths, the cube medium is formed by protruding outwardly at least one end face, or by overall or partially growing films on a surface, or is composed of cube-like shapes with approximate side lengths or cube mediums with equal side lengths, the cube mediums is formed by concaving at least one end face and overall or partially growing film mediums. The dielectric resonance block is made of a ceramic or medium.

In some embodiments, the dielectric resonance block 2 is directly formed by a cube-like shape with approximate side lengths or by directly outwardly protruding at least one end face of a cube medium with equal side lengths, or is composed of cube-like shapes with approximate side lengths or cube mediums with equal side lengths, the cube mediums is formed by outwardly protruding at least one end face and overall or partially growing film mediums. The dielectric resonance block 2 is made of a ceramic or medium.

In some embodiments, the interior of the dielectric resonance block 2 may be overall or partially hollowed. The hollowed part is partially or overall filled or cube-like nested mediums are circularly nested. The nested mediums may be of solid structures or overall or partially hollowed. The hollowed parts of the nested mediums are partially or overall filled or cube-like nested mediums are circularly nested.

In the above solution, one or more dielectric support frames 3 are designed. When more dielectric support frames 3 are arranged, the more dielectric support frames 3 are respectively installed between different faces of the dielectric resonance block 2 and inner walls of the cavity. FIG. 9 of an embodiment of the disclosure shows six dielectric support frames 3. The dielectric resonance block is positioned in the center of the six dielectric support frames. Six faces A1-A6 of the dielectric resonance block 2 are respectively connected with the six dielectric support frames 3. In an embodiment, the six dielectric support frames 3 are respectively a first dielectric support frame B1, a second dielectric support frame B2, a third dielectric support frame B3, a fourth dielectric support frame B4, a fifth dielectric support frame B5 and a sixth dielectric support frame B6. An end face A1 of dielectric resonance block 3 along the X direction is connected with the first dielectric support frame B1, and another end face A2 is connected with the second dielectric support frame B2, thus to form an X-axis dielectric resonance rod. An end face A3 of the dielectric resonance block 2 along the Y direction is connected with the third dielectric support frame B3, and another end face A4 is connected with the fourth dielectric support frame B4, thus to form a Y-axis dielectric resonance rod. An end face A5 of the dielectric resonance block 2 along the Z direction is connected with the fifth dielectric support frame B5, and another end face A6 is connected with the sixth dielectric support frame B6.

Shapes of more dielectric support frames 3 include, but not limited to, circles, ellipses, squares and irregular shapes that inner walls of the cavity are tightly matched with corresponding medium end faces. Materials of the dielectric support frame 3 include, but not limited to, plastics, mediums and air, and the dielectric support frame is of a solid structure or a structure with a hollow center. The dielectric resonance block 2 and the dielectric support frame 3 are connected in modes of, but not limited to, gluing and crimping. The dielectric resonance block and the dielectric support frame are connected in modes of, but not limited to, gluing, crimping, screw fastening and welding. The cavity takes a cube-like shape or a cube shape. The cavity is made of a metallic material, or the cavity is made of a metallic material and an inner wall of the metallic material is coated by silver or copper, or the cavity is made of a nonmetallic material of which the surface is coated by a metallic layer. In order to reduce variation of frequencies at different ambient temperatures, material proportions of the dielectric resonance block may be adjusted according to different temperature divination to control frequency deviation, in addition, in order to ensure structure reliability, the dielectric support frame is made of an elastic material such as a plastic, so that the dielectric support frame of the structure is capable of counteracting influence of thermal expansion and cold contraction in different environments.

The dielectric support frame of the solid structure takes a shape of a solid structure, or is of a through tubular structure in the middle, or is a combination of multiple independent solid columns.

The dielectric support frame of the solid structure is made of plastics, ceramics or mediums, and a dielectric support frame of a non-solid structure is made of air.

Two end faces of the dielectric resonance block along the X direction are connected with the first dielectric support frame and the second dielectric support frame in a mode of gluing or crimping. Two end faces of the dielectric resonance block along the Y direction are connected with the third dielectric support frame and the fourth dielectric support frame in a mode of gluing or crimping. Two end faces of the dielectric resonance block along the Z direction are connected with the fifth dielectric support frame and the sixth dielectric support frame in a mode of gluing or crimping.

In an embodiment, a total resonance rod formed by resonance rods in three X, Y and Z directions and the cavity form a triple-mode resonance cavity structure. The cavity takes the cube shape or cube-like shape. The cavity is made of the metallic material, or the cavity is made of the metallic material and the inner wall of the metallic material is coated by silver or copper, or the cavity is made of the nonmetallic material of which the surface is coated by the metallic layer.

In an embodiment, the total resonance rod formed by resonance rods in three X, Y and Z directions is connected with the inner wall of the cavity in a mode of gluing, crimping, screw fastening or welding. The total resonance rod formed by resonance rods in three X, Y and Z directions has compensation of frequencies along with temperature variation. The structure of the dielectric support frame of the total resonance rod formed by resonance rods in three X, Y and Z directions counteracts influence caused by thermal expansion and cold contraction in different environments by using a material of certain elasticity or a shape of an elastic structure, and the elastic material of the dielectric support frame is a plastic, a medium, a composite material, aluminum oxide and the like.

In the above solution, the resonance frequency of the degenerate triple mode in the direction of the X axis is achieved by additionally installing the tuning screw or the tuning disc at the place with concentrated field intensity on one or two faces of the X axis corresponding to the cavity so as to change the distance or change capacitance; the resonance frequency in the direction of the Y axis is achieved by additionally installing the tuning screw or the tuning disc at the place with concentrated field intensity on one or two faces of the Y axis corresponding to the cavity so as to change the distance or change capacitance; and the resonance frequency in the direction of the Z axis is achieved by additionally installing the tuning screw or the tuning disc at the place with concentrated field intensity on one or two faces of the Z axis corresponding to the cavity so as to change the distance or change capacitance.

The tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium.

The tuning screw takes the shape of any one of metallic rods, medium rods, metallic discs, medium discs, metallic rods with metallic discs, metallic rods with medium discs, medium rods with metallic discs and medium rods with medium discs.

In the above solution, at least two nonparallel arranged coupling structures for breaking orthogonality of degenerate mufti-mode electromagnetic fields in the cavity are disposed on the dielectric resonance block and/or non-corresponding parts of the cavity. The coupling structures include cut corners and holes arranged beside the edges of the dielectric resonance block and/or cut corners beside the edges of the cavity. The cut corners take the shape of a triangular prism or cube-like shape or sector. In the three degenerate modes, coupling of a degenerate mode in the X direction with a degenerate mode in the Y direction is achieved by a first plane which is formed by cutting off a part of a corner along the direction of the Z axis and the corner is formed by cross X and Y planes of the dielectric resonance block. Coupling screws are disposed on edges formed by cross X and Y planes of the cavity in a parallel or perpendicular manner to achieve fine tuning of coupling amounts. Coupling of the degenerate mode in the Y direction with a degenerate mode in the Z direction is achieved by a second plane which is formed by cutting off a part of a corner along the direction of the X axis, and the corner is formed by cross Y and Z planes of the dielectric resonance block. Coupling screws are disposed on edges formed by cross Y and Z planes of the cavity in a parallel or perpendicular manner to achieve fine tuning of coupling amounts. Coupling of the degenerate mode in the Z direction with the degenerate mode in the X direction is achieved by a third plane which is formed by cutting off a part of a corner along the direction of the Y axis, and the corner is formed by cross Z and X planes of a dielectric resonance block. Coupling screws are disposed on edges formed by cross Z and X planes of the cavity in a parallel or perpendicular manner to achieve fine tuning of coupling amounts.

In an embodiment, the coupling screw is made of a metal, or the coupling screw is made of a metal and the metal is electroplated by copper or electroplated by silver, or the coupling screw is made of a medium, or the coupling screw is made of a surface metallized medium.

In an embodiment, the coupled screw takes a shape of any one of metallic rods, medium rods, metallic discs, medium discs, metallic rods with metallic discs, metallic rods with medium discs, medium rods with metallic discs and medium rods with medium discs.

In an embodiment, a radio frequency channel is formed by coupling of a resonance mode in the X direction and a resonance mode in the Y direction and coupling of a resonance mode in the Y direction and a resonance mode in the Z direction to cause loss and generate heat, the six dielectric support frames are sufficiently connected with the inner wall of the cavity to achieve heat conduction, and thus the heat is dissipated.

In an embodiment, multi-mode resonance structures with small distances, single-mode resonance cavities and triple-mode resonance cavities of different modes are combined in different modes to form filters of different volumes.

The filter has function properties of band pass, band stop, high pass, low pass and a combiner formed thereby.

Coupling of any two resonance cavities formed by permutation and combination of a triple-mode dielectric resonance cavity and any one of a single-mode resonance cavity, a dual-mode resonance cavity and a triple-mode resonance cavity is achieved through a size of a window between the two resonance cavities necessarily when resonance rods in the two resonance cavities are parallel.

It should be understood that the above is only embodiments of the disclosure, but the scope of protection of the disclosure is not limited to this. Changes or replacements easily made by any of those skilled in the art within the scope of the technology disclosed by the disclosure shall be covered by the scope of protection of the disclosure. The contents not described in detail in the description belong to the art known to those skilled in the art.

What is claimed is:

1. An outwardly protruding triple-mode cavity resonance structure, comprising a cavity and a cover plate, wherein the cavity is internally provided with a dielectric resonance block and a dielectric support frame; wherein the cavity takes a cube-like shape and at least one end face protrudes outwards; the dielectric resonance block takes a cube-like shape; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block;

a ratio K of a size of a single side of the inner wall of the cavity to a size of a corresponding single side of the dielectric resonance block is: when K is greater than or equal to a transition point 1 and is smaller than or equal to a transition point 2, a Q value of a higher-order mode, adjacent to a base mode, of the triple-mode dielectric resonance structure is transited into a Q value of the base mode of the triple-mode cavity resonance structure, a base-mode resonance frequency after transition is equal to a base-mode resonance frequency prior to transition, a Q value of the base mode after transition is greater than a Q value of the base mode prior to transition, and a Q value of the higher-order mode adjacent to the base mode after transition is smaller than the Q value of the higher-order mode adjacent to the base mode prior to transition;

the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing resonance frequencies of the degenerate triple-mode in the cavity.

2. The outwardly protruding triple-mode cavity resonance structure as claimed in claim 1, wherein the dielectric resonance block is of a solid structure or hollow structure, a hollow part of the dielectric resonance block of a hollow structure is filled with air or a nested dielectric resonance block, and a volume of the nested dielectric resonance block is smaller than or equal to a volume of a hollow chamber.

3. The outwardly protruding triple-mode cavity resonance structure as claimed in claim 2, wherein the nested dielectric resonance block, takes a cube-like shape and at least one end face protrudes outwards.

4. The outwardly protruding triple-mode cavity resonance structure as claimed in claim 3, wherein a film medium is arranged on at least one end face of the nested dielectric resonance block.

5. The outwardly protruding triple-mode cavity resonance structure as claimed in claim 1, wherein a film medium is arranged on at least one end face of the cavity or/and at least one end face of the dielectric resonance block.

6. The outwardly protruding triple-mode cavity resonance structure as claimed in claim 1, wherein a value of the transition point 1 and a value of the transition point 2 both vary according to different base-mode resonance frequencies of the dielectric resonance block, dielectric constants of the dielectric resonance block and dielectric constants of the support frame.

7. The outwardly protruding triple-mode cavity resonance structure as claimed in claim 1, wherein when the base-mode resonance frequency of the dielectric resonance block after transition remains unchanged, the Q value of the triple-mode dielectric resonance structure is relevant to the K value, the dielectric constant of the dielectric resonance block and the size of the dielectric resonance block.

8. The outwardly protruding triple-mode cavity resonance structure as claimed in claim 1, wherein when the K value is increased to the maximum from 1.0, the K value has three Q value transition points within a variation range, each Q value transition point enables the Q value of the base mode of the K value and the Q value of the higher-order mode adjacent to the base mode of the K value to be transited; when the Q value of the base mode is lower than the Q value of the higher-order mode adjacent to the base mode, the Q value of the higher-order mode adjacent to the base mode is transited into the Q value of the base mode, and the Q value of the base mode is higher than that prior to transition: and when the Q value of the base mode is higher than the Q value of the higher-order mode adjacent to the base mode, the Q value of the higher-order mode adjacent to the base mode is transited into the Q value of the base mode, and the value of the base mode is lower than that prior to transition.

9. The outwardly protruding triple-mode cavity resonance structure as claimed in claim 8, wherein in four areas formed by a start point and a final point of the K value and the three value 0 transition points, the Q value of the base mode and the Q value of the higher-order mode adjacent to the base mode vary along with variation of cavity sizes and dielectric resonance rod sizes, and different areas have different requirements when being applied to a filter.

10. The outwardly protruding triple-mode cavity resonance structure, as claimed in claim 1, wherein when the cavity and the dielectric resonance block have a same size in X, Y and Z axes, a degenerate triple mode is formed, and the degenerate triple mode is coupled with other single cavities to form a passband filter;

when differences of sizes of the cavity and the dielectric resonance block in three directions along the X, Y and Z axes are slightly unequal, orthogonal-like triple-mode resonance is formed, if an orthogonal-like triple-mode is capable of coupling with other cavities into a passband filter, the sizes are acceptable, and if the orthogonal-like triple-mode is not capable of coupling with other cavities into the passband filter, the sizes are unacceptable; and when the differences of the sizes of the cavity and the dielectric resonance block in the three directions along the X, Y and Z axes are greatly different, the degenerate triple-mode or orthogonal-like triple-mode cannot be formed, three modes of different frequencies are formed instead, thus the modes cannot be coupled with, other cavities into the passband filter, and the sizes are unacceptable.

11. The outwardly protruding triple-mode cavity resonance structure as claimed in claim 10, wherein the outwardly protruding triple-mode cavity resonance structure forms the degenerate triple-mode in directions along the X, Y and Z axes; a resonance frequency of the degenerate triple-mode in an X-axis direction is achieved by additionally installing a tuning screw or a tuning disc at a place with concentrated field intensity on one or two faces of the X axis corresponding to the cavity so as to change a distance or change capacitance; a resonance frequency in a Y-axis direction is achieved by additionally installing a tuning screw or a tuning disc at a place with concentrated field intensity on one or two faces of the Y axis corresponding to the cavity so as to change a distance or change capacitance; and a resonance frequency in Z-axis direction is achieved by additionally installing a tuning screw or a tuning disc at a place with concentrated field intensity on one or two faces of the Z axis, corresponding to the cavity so as to change a distance or change capacitance.

12. The outwardly protruding triple-mode cavity resonance structure as claimed in claim 11, wherein the outwardly protruding triple-mode cavity resonance structure forms, the degenerate triple-mode in directions along the X, Y and Z axes, and the frequency of the degenerate triple-mode is adjusted by changing a dielectric constant; dielectric constant films of different shapes and thicknesses are adhered to a surface of the dielectric resonance block, the, inner wall of the cavity, an inner wall of the cover plate or a bottom of the tuning screw, and the dielectric constant films are made of a ceramic medium or a ferroelectric material;

the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium; and the tuning screw takes the shape of any one of metallic rods, medium rods, metallic discs, medium discs, metallic rods with metallic discs, metallic rods with medium discs, medium discs with metallic discs and medium rods with medium discs.

13. The outwardly protruding triple-mode cavity resonance structure as claimed in claim 1, wherein, the outwardly protruding triple-mode cavity resonance structure is internally provided with at least two nonparallel arranged coupling devices for changing orthogonal properties of a degenerate triple-mode electromagnetic field in the cavity, each coupling device comprises cut corners/chamfers/grooves disposed on edges of the dielectric resonance block, or comprises chamfers/cut corners disposed at inner corners of the cavity, or comprises cut corners/chamfers/grooves disposed beside edges of the dielectric resonance block and chamfers/cut corners beside edges of the cavity, or comprises tapping lines or/pieces arranged on nonparallel planes in the. cavity;

the cut corners take a shape of a triangular prism or a cuboid or a sector;

after corner cutting, in case of frequency holding, side lengths of the dielectric resonance block are increased, and the Q value is slightly decreased;

depths of the cut corners or holes are of through or partial cut corners/partial hole structures according to required coupling amounts;

the coupling amounts are affected by sizes of the cut corners/chamfers/holes;

a coupling tuning structure comprises a coupling screw disposed in a direction perpendicular or parallel to the cut corners; the coupling screw is, made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs, medium discs with metallic discs and medium rods with medium discs.

14. The outwardly protruding triple-mode cavity resonance structure as claimed in, claim 1, wherein the outwardly protruding triple-mode cavity resonance structure is internally provided with at least two nonparallel arranged coupling devices for changing orthogonal properties of a degenerate triple-mode electromagnetic field in the cavity, each coupling device comprises holes/grooves arranged on an end face of the dielectric resonance block; central lines of the holes or grooves are parallel to edges perpendicular to the end surfaces with the holes or the grooves of the dielectric resonance block, or each coupling device comprises chamfers/cut corners arranged at inner corners of the cavity, or comprises holes/grooves arranged in the end faces of the dielectric resonance block and chamfers/cut corners beside edges of the cavity, or comprises tapping lines or/pieces arranged on nonparallel planes in the cavity;

depths of the holes are of through hole structures or partial hole structures according to required coupling amounts;

the coupling amounts are affected by the sizes of the holes;

the holes/grooves take a shape of a circle, a rectangle or a polygon, and after the holes/grooves are formed, in case of frequency holding, side lengths of the dielectric resonance block are increased, and the Q value is slightly decreased;

a coupling tuning structure comprises a coupling screw arranged in a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs, medium discs with metallic discs and medium rods with medium discs.

15. The outwardly protruding triple-mode cavity resonance structure as claimed in claim 1, wherein the cavity takes the cube-like shape: to achieve coupling of three modes, on premise that the size of the dielectric resonance block is not changed, cut sides for achieving coupling of the three modes are processed on any two adjacent faces of the cavity; sizes of the cut sides are relevant to required coupling amounts; coupling of two of the three modes is achieved through the cut sides of the cavity; other coupling is achieved through cut corners of two adjacent sides of the cavity; walls are not broken when corners of the adjacent sides of the cavity are cut; cut corner faces need to be completely sealed with the cavity; a surface of the cavity is electroplated by copper or electroplated by silver; the cavity is made of a metal or a nonmetal material; and when the cavity is made of the nonmetal material, the inner wall of the cavity is electroplated by a conductive material.

16. The outwardly protruding triple-mode cavity resonance structure as claimed in claim 1, wherein when the cavity takes the cube-like shape, the dielectric resonance block and the dielectric support frame are installed in any one axial direction of the cavity, and a center of the dielectric resonance block coincides with or approaches to a center of the cavity.

17. The outwardly protruding triple-mode cavity resonance structure as claimed in claim 1, wherein the dielectric constant of the dielectric support frame is similar to an air dielectric constant; the dielectric support frame is free of influence upon triple-mode resonance frequencies; the dielectric support frame supports with any one single face of the dielectric resonance block, or supports with six faces, or supports with different combinations of two different faces, three faces, four faces and five faces; a number of the dielectric support frame on each face is one or more;

and one or more support frames is installed on different faces according to demands.

18. The outwardly protruding triple-mode cavity resonance structure as claimed in claim 17, wherein a single face support combination supports any one face of the dielectric resonance block, and particularly a bottom surface or bearing surface in a vertical direction;

a support combination of two faces comprises parallel faces such as upper and lower faces, front and rear faces and left and right faces, and also comprises nonparallel faces such as upper and front faces, upper and rear faces, upper and left faces and upper and right faces;

a support combination of three faces comprises three faces perpendicular to one another, or two parallel faces and one nonparallel face;

a support combination of four faces comprises two pairs of parallel faces or a pair of parallel faces and two another nonparallel faces;

a support combination of five faces comprises support structures on other faces except any one face of a front face/a rear face/a left face/a right face/an upper face/a lower face; and a support combination of six faces comprises support structures on all faces of a front face/a rear face/a left face/a right face/an up face/a down face.

19. The outwardly protruding triple-mode cavity resonance structure as claimed in claim 1, wherein the dielectric constant of the dielectric support frame is greater than an air dielectric constant and smaller than the dielectric constant of the dielectric resonance block; to hold original triple-mode frequencies, a size corresponding to an axial direction of the dielectric resonance block of the dielectric support frame is slightly reduced; the dielectric support frame supports with any one single face of the dielectric resonance block, or supports with six faces, or supports with different combinations of two different faces, three faces, four faces and five faces; a face without the support frame is an air face; the air face is arbitrarily combined with the dielectric support frame; a number of the dielectric support frame on each face is one or more, or the dielectric support frame on each face is a complex dielectric constant support frame composed of multiple layers of different dielectric constant medium materials; single-layer and multi-layer medium material support frames are arbitrarily combined with cube-like medium blocks; one or more dielectric support frames is, installed on different faces according to demands; on faces with the dielectric support frames, to hold the triple-mode frequencies and the Q value, the size corresponding to the axial direction of the dielectric resonance block of the dielectric support frame is slightly reduced.

20. The outwardly protruding triple-mode cavity resonance structure as claimed in claim 19, wherein a single face support combination supports any one face of the dielectric resonance block, and particularly a bottom surface or bearing surface in a vertical direction;

a support combination of two faces comprises parallel faces such as upper and lower faces, front and rear faces and left and right faces, and also comprises nonparallel faces such as upper and front faces, upper and rear faces, upper and left faces and upper and right faces;

a support combination of three faces comprises three faces perpendicular to one another, or two parallel faces and one nonparallel face;

a support combination of four faces comprises two pairs of parallel faces pair of parallel faces and two another nonparallel faces;

a support combination of five faces comprises support structures on other faces except any one face of a front face/a rear face/a left face/a right face/an upper face/a lower face; and a support combination of six faces comprises support structures on all faces of a front face/a rear face/a left face/a right face/an up face/a down face.

21. The outwardly protruding triple-mode cavity resonance structure as claimed in claim 1, wherein a surface area of the dielectric support frame is smaller than or equal to a surface area of the dielectric resonance block; the dielectric support frame is a cylinder, a cube or a cuboid;

the dielectric support frame is of a solid structure or hollow structure; the dielectric support frame of the hollow structure comprises a single hole or multiple holes; each hole takes a shape of a circle, a square, a polygon and an arc; and the dielectric support e is made of air, plastics, ceramics and mediums.

22. The outwardly protruding triple-mode cavity resonance structure as claimed in claim 1, wherein the dielectric support frame and the dielectric resonance block are connected in a mode of crimping, adhesion or sintering; and the dielectric support frame and the inner wall of the cavity are connected in a mode of adhesion crimping, welding, sintering or screw fixation.

23. The outwardly protruding triple-mode cavity resonance structure as claimed in claim 1, wherein a radio frequency channel formed by coupling of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

24. The outwardly protruding triple-mode cavity resonance structure as claimed in claim 1, wherein a frequency temperature coefficient of the dielectric resonance block is controlled by adjusting proportions of medium materials, and is compensated according to frequency deviation variation of a filter at different temperatures.

25. The outwardly protruding triple-mode cavity resonance structure as claimed in claim 24, wherein the dielectric resonance block has a single dielectric constant or composite dielectric constants; the dielectric resonance block with the composite dielectric constants is formed by at least two materials of different dielectric constants; the at least two materials of different dielectric constants are combined up and down, left and right, asymmetrically or in a nested mode; when the at least two materials of different dielectric constants are nested in the dielectric resonance block, one or more layers are nested; the dielectric resonance block with the composite dielectric constants needs to comply with variation rules of the Q value transition points; when the dielectric resonance block is subjected to cut side coupling among triple modes, to hold a required frequency, corresponding side lengths of two faces adjacent to the cut sides are adjusted; the dielectric resonance block is made of a ceramic or medium material; and medium sheets of different thicknesses and different dielectric constants are added on a surface of the dielectric resonance block.

26. A filter with a outwardly protruding triple-mode cavity resonance structure, comprising a cavity, a cover plate and an input/output structure, wherein the cavity is internally provided with at least one outwardly protruding triple-mode cavity resonance structure as claimed in claim 1;

the outwardly protruding triple-mode cavity resonance structure is combined with a single-mode resonance structure, a dual-mode resonance structure and a triple-mode resonance structure in different modes to form filters of different volumes;

a coupling of any two resonance cavities formed by permutation and combination of the outwardly protruding triple-mode cavity resonance structure and any one of the single-mode resonance structure, the dual-mode resonance structure and the triple-mode resonance structure is achieved through a size of a window between the two resonance cavities, necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

27. An outwardly protruding triple-mode cavity resonance structure, comprising a cavity and a cover plate, wherein the cavity is internally provided with a dielectric resonance block and a dielectric support frame; the cavity takes a cube-like shape; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block;

a ratio K of the size of a single side of the inner wall of the cavity to the size of a single side of the dielectric resonance block is: when K is greater than or equal to a transition point 1 and is smaller than or equal to a transition point 2, a Q value of a high-order mode adjacent to a base mode is transited into a value of the base mode of the triple-mode cavity resonance structure, a base-mode resonance frequency after transition is equal to a base-mode resonance frequency prior to transition, a 0 value of the base mode after transition is greater than a Q value of the base mode prior to transition, and a value of the high-order mode adjacent to the base mode after transition is smaller than a Q value of the high-order mode adjacent to the base mode prior to transition;

the triple-mode dielectric resonance structure is internally provided with a coupling structure for changing orthogonal properties of a degenerate triple-mode electromagnetic field in the cavity; and the triple-mode dielectric resonance structure is internally provided with a frequency tuning device for changing degenerate triple-mode resonance frequencies in the cavity.

28. The outwardly protruding triple-mode cavity resonance structure as claimed in claim 27, wherein the dielectric resonance block is of a solid structure or hollow structure, a hollow part of the dielectric resonance block of a hollow structure is filled with air or a nested dielectric resonance block, and a volume of the nested dielectric resonance block is, smaller than or equal to a volume of a hollow chamber.

29. The outwardly protruding triple-mode cavity resonance structure as claimed in claim 27, wherein a film medium is arranged on at least one end face of the cavity or/and at least one end face of the dielectric resonance block.

30. The outwardly protruding triple-mode cavity resonance structure as claimed in claim 27, wherein a value of the transition point 1 and a value of the transition point 2 both vary according to different base-mode resonance frequencies of the dielectric resonance block, dielectric constants of the dielectric resonance block and dielectric constants of the support frame.

31. The outwardly protruding triple-mode cavity resonance structure as claimed in claim 27, wherein when the base-mode resonance frequency of the dielectric resonance block after transition remains unchanged, the Q value of the triple-mode dielectric resonance structure is relevant to the K value, the dielectric constant of the dielectric resonance block and the size of the dielectric resonance block.

32. The outwardly protruding triple-mode cavity resonance structure as claimed in claim 27, wherein when the K value is increased to the maximum from 1.0 the K value has three Q value transition points within a variation range, each Q value transition point enables the value of the base mode of the K value and the Q value of the higher-order mode adjacent to the base mode of the K value to be transited; when the Q value of the base mode is lower than the Q value of the higher-order mode adjacent to the base mode, the Q value of the higher-order mode adjacent to the base mode is transited into the Q value of the base mode, and the Q value of the base mode is higher than that prior to transition; and when the Q value of the base mode is higher than the Q value of the higher-order mode adjacent to the base mode, the Q value of the higher-order mode adjacent to the base mode is transited into the Q value of the base mode, and the Q value of the base mode is lower than that prior to transition.

33. The outwardly protruding triple-mode cavity resonance structure as claimed in claim 27, wherein when the cavity and the dielectric resonance block have a same size in X, Y and Z axes, a degenerate triple mode is formed, and, the degenerate triple mode is coupled with other single cavities to form a passband filter;

when differences of sizes of the cavity and the dielectric resonance block in three directions along the X, Y and Z axes are slightly unequal, orthogonal-like triple-mode resonance is formed, if an orthogonal-like triple-mode is capable of coupling with other cavities into a passband filter, the sizes are acceptable, and if the orthogonal-like triple-mode is not capable of coupling with other cavities into the passband filter, the sizes are unacceptable; and when the differences of the sizes of the cavity and the dielectric resonance block in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

34. The outwardly protruding triple-mode cavity resonance structure as claimed in claim 27, wherein the outwardly protruding triple-mode cavity resonance structure is internally provided with at least two nonparallel arranged coupling devices for changing orthogonal properties of a degenerate triple-mode electromagnetic field in the cavity, each coupling device comprises cut comers/chamfers/grooves disposed on edges of the dielectric resonance block, or comprises chamfers/cut corners disposed at inner corners of the cavity, or comprises cut corners/chamfers/grooves disposed beside edges of the dielectric resonance block and chamfers/cut corners beside edges of the cavity, or comprises tapping lines or/pieces arranged on nonparallel planes in the cavity;

the cut corners take a shape of a triangular prism or a cuboid or a sector; after corner cutting, in case of frequency holding, side lengths of the dielectric resonance block are increased, and the Q value is slightly decreased;

depths of the cut corners or holes are of through or partial cut corners/partial hole structures according to required coupling amounts;

the coupling amounts are affected by sizes of the cut comers/chamfers/holes;

a coupling tuning structure comprises a coupling screw disposed in a direction perpendicular or parallel to the cut corners; the coupling screw is made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs. medium discs with metallic discs and medium rods with medium discs.

35. The outwardly protruding triple-mode cavity resonance structure as claimed in claim 27, wherein the outwardly protruding triple-mode cavity resonance structure is internally provided with at least two nonparallel arranged coupling devices for changing orthogonal properties of a degenerate triple-mode electromagnetic field in the cavity, each coupling device comprises holes/grooves arranged on, an end face of the dielectric resonance block; central lines of the holes or grooves are parallel to edges perpendicular to the end surfaces with the holes or the grooves of the dielectric resonance block, or each coupling device comprises chamfers/cut corners arranged at inner corners of the cavity, or comprises holes/grooves arranged in the end faces of the dielectric resonance block and chamfers/cut corners beside edges of the cavity, or comprises tapping lines or/pieces arranged on nonparallel planes in the cavity;

depths of the holes are of through hole structures or partial hole structures according to required coupling amounts;

the coupling amounts are affected by the sizes of the holes;

the holes/grooves take a shape of a circle, a rectangle or a polygon, and after the holes/grooves are formed, in case of frequency holding, side lengths of the dielectric resonance block are increased, and the Q value is slightly decreased;

a coupling tuning structure comprises a coupling screw arranged in a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs, medium discs with metallic discs and medium rods with medium discs.

36. The outwardly protruding triple-mode cavity resonance structure as claimed in claim 27, wherein the cavity takes the cube-like shape; to achieve coupling of three modes, on premise that the size of the dielectric resonance block is not changed, cut sides for achieving coupling of the three modes are processed on any two adjacent faces of the cavity; sizes of the cut sides are relevant to required coupling amounts; coupling, of two of the three modes is achieved through the cut sides of the cavity; other coupling is achieved through cut corners of two adjacent sides of the cavity; walls are not broken when corners of the adjacent sides of the cavity are cut; cut corner faces need to be completely sealed with the cavity; a surface of the cavity is electroplated by copper or electroplated by silver; the cavity is made of a metal or a nonmetal material; and when the cavity is made of the nonmetal material, the inner wall of the cavity is electroplated by a conductive material.

37. The outwardly protruding triple-mode cavity resonance structure as claimed in claim 27, wherein when the cavity takes the cube-like shape, the dielectric resonance block and the dielectric support frame are installed in any one axial direction of the cavity, and a center of the dielectric resonance block coincides with or approaches to a center of the cavity.

38. The outwardly protruding triple-mode cavity resonance structure as claimed in claim 27, wherein the dielectric constant of the dielectric support frame is similar to an air dielectric constant; the dielectric support frame is free of influence upon triple-mode resonance frequencies; the dielectric support frame supports with any one single face of the dielectric resonance block, or supports with six faces, or supports with different combinations of two different faces, three faces, four faces and five faces; a number of the dielectric support frame on each face is one or more; and one or more support frames is installed on different faces according to demands.

39. The outwardly protruding triple-mode cavity resonance structure as claimed in claim 27, wherein the dielectric constant of the dielectric support frame is greater than, an, air dielectric constant and smaller than the dielectric constant of the dielectric resonance block; to hold original triple-mode frequencies, a size corresponding to an axial direction of the dielectric resonance block of the dielectric support frame is slightly reduced; the dielectric support frame supports with any one single face of the dielectric resonance block, or supports with six faces, or supports with different combinations of two different faces, three faces, four faces and five faces; a face without the support frame is an air face; the air face is arbitrarily combined with the dielectric support frame; a number of the dielectric support frame on each face is one or more, or the dielectric support frame on each face is a complex dielectric constant support frame composed of multiple layers of different dielectric constant medium materials: single-layer and multi-layer medium material support frames are arbitrarily combined with cube-like medium blocks; one or more dielectric support frames is installed on different faces according to demands; on faces with the dielectric support frames, to hold the triple-mode frequencies and the Q value, the size corresponding to the axial direction of the dielectric resonance block of the dielectric support frame is slightly reduced.

40. The outwardly protruding triple-mode cavity resonance structure as claimed in claim 27, wherein a surface area of the dielectric support frame is smaller than or equal to a surface area of the dielectric resonance block; the dielectric support frame is a cylinder, a cube or a cuboid;

the dielectric support frame is of a solid structure or hollow structure; the dielectric support frame of the hollow structure comprises a single hole or multiple holes; each hole takes a shape of a circle, a square, a polygon and an arc; and the dielectric support frame is made of air, plastics, ceramics and mediums.

41. The outwardly protruding triple-mode cavity resonance structure as claimed in claim 27, wherein the dielectric support frame and the dielectric resonance block are connected in a mode of crimping, adhesion or sintering;

and the dielectric support frame and the inner wall of the cavity are connected in a mode of adhesion, crimping, welding, sintering or screw fixation.

42. The outwardly protruding triple-mode cavity resonance structure as claimed in claim 27, wherein a radio frequency channel formed by coupling of radio frequency signals, in directions of X, Y and Z axes, of the triple mode causes loss and generates heat, the dielectric resonance block is sufficiently connected with the inner wall of the cavity through the dielectric support frame, and thus the heat is conducted into the cavity for heat dissipation.

43. The outwardly protruding triple-mode cavity resonance structure as claimed in claim 27, wherein a frequency temperature coefficient of the dielectric resonance block is controlled by adjusting proportions of medium materials, and is compensated according to frequency deviation variation of a filter at different temperatures.

44. A filter with a outwardly protruding triple-mode cavity resonance structure, comprising a cavity, a cover plate and an input/output structure, wherein the cavity is internally provided with at least one outwardly protruding triple-mode cavity resonance structure as claimed in claim 27;

the outwardly protruding triple-mode cavity resonance structure is combined with a single-mode resonance structure, a dual-mode resonance structure and a triple-mode resonance structure in different modes to form filters of different volumes;

a coupling of any two resonance cavities formed by permutation and combination of the outwardly protruding triple-mode cavity resonance structure and any one of the single-mode resonance structure, the dual-mode resonance structure and the triple-mode resonance structure is achieved through a size of a window between the two resonance cavities, necessarily when resonance rods in the two, resonance cavities are parallel, and the size of the window is determined according to a coupling amount: and the filter has function properties of band pass, band stop, high pass, low pass and a duplexer, a multiplexer and a combiner formed thereby.

45. An outwardly protruding triple-mode cavity resonance structure, comprising a cavity and a cover plate, wherein the cavity is internally provided with a dielectric resonance block and a dielectric support frame; the cavity takes a cube-like shape and at least one end face protrudes outwards; the dielectric resonance block takes a cube-like shape and at least one end face protrudes outwards; the dielectric support frame is connected with the dielectric resonance block and an inner wall of the cavity, respectively; the dielectric resonance block and the dielectric support frame form a triple-mode dielectric resonance rod; a dielectric constant of the dielectric support frame is smaller than a dielectric constant of the dielectric resonance block;

a ratio K of the size of a single side of the inner wall of the cavity to the size of a single side of the dielectric resonance block is: when K is greater than or equal to a transition point 1 and is smaller than or equal to a transition point 2, a Q value of a high-order mode adjacent to a base mode is transited into a Q value of the base mode of the triple-mode dielectric resonance structure, a base-mode resonance frequency after transition is, equal to a base-mode resonance frequency prior to transition, a Q value of the base mode after transition is greater than a Q value of the base mode prior to transition, and a Q value of the high-order mode adjacent to the base mode after transition is smaller than a Q value of the high-order mode adjacent to the base mode prior to transition;

the triple-mode dielectric resonance structure is internally provided with a coupling structure for changing orthogonal properties of a degenerate triple-mode electromagnetic field, in the cavity; and the triple-mode dielectric resonance structure is internally provided with a frequency tuning device for changing degenerate triple-mode resonance frequencies in the cavity.

46. The outwardly protruding triple-mode cavity resonance structure as claimed in claim 45, wherein the dielectric resonance block is of a solid structure or hollow structure, a hollow part of the dielectric resonance block of a hollow structure is filled with air or a nested dielectric resonance block, and a volume of the nested dielectric resonance block is smaller than or equal to a volume of a hollow chamber.

47. The outwardly protruding triple-mode cavity resonance structure as claimed in claim 45, wherein a film medium is arranged on at least one end face of the cavity or/and at least one end face of the dielectric resonance block.

48. The outwardly protruding triple-mode cavity resonance structure as claimed in claim 45, wherein a value of the transition point 1 and a value of the transition point 2 both vary according to different base-mode resonance frequencies of the dielectric resonance block, dielectric constants of the dielectric resonance block and dielectric constants of the support frame.

49. The outwardly protruding triple-mode cavity resonance structure as claimed in claim 45, wherein when the base-mode resonance frequency of the dielectric resonance block after transition remains unchanged, the Q value of the triple-mode dielectric resonance structure is relevant to the K value, the dielectric constant of the dielectric resonance block and the size of the dielectric resonance block.

50. The outwardly protruding triple-mode cavity resonance structure as claimed in claim 45, wherein when the K value is increased to the maximum from 1.0, the K value has three Q value transition points within a variation range, each Q value transition point enables the Q value of the base mode of the K value and the Q value of the higher-order mode adjacent to the base mode of the K value to be transited; when the Q value of the base mode is lower than the Q value of the higher-order mode adjacent to the base mode, the Q value of the higher-order mode adjacent to the base mode is transited into the Q value of the base mode, and the Q value of the base mode is higher than that prior to transition; and when the Q value of the base mode is higher than the Q value of the higher-order mode adjacent to the base mode, the Q value of the higher-order mode adjacent to the base mode is transited into the value of the base mode, and the Q value of the base mode is lower than that prior to transition.

51. The outwardly protruding triple-mode cavity resonance structure as claimed in claim 45, wherein when the cavity and the dielectric resonance block have a same size in X, Y and Z axes, a degenerate triple mode is formed, and, the degenerate triple mode is coupled with other single cavities to form a passband filter;

when differences of sizes of the cavity and the dielectric resonance block in three directions along the X, Y and Z axes are slightly unequal, orthogonal-like triple-mode resonance is formed, if an orthogonal-like triple-mode is capable of coupling with other cavities into a passband filter, the sizes are acceptable, and if the orthogonal-like triple-mode is not capable of coupling with other cavities into the passband filter, the sizes are unacceptable; and when the differences of the sizes of the cavity and the dielectric resonance block in the three directions along the X, Y and Z axes are greatly different, the degenerate triple-mode or orthogonal-like triple-mode cannot be formed, three modes of different frequencies are formed instead, thus the modes cannot be coupled with other cavities into the passband filter, and the sizes are unacceptable.

52. The outwardly protruding triple-mode cavity resonance structure as claimed in claim 45, wherein the outwardly protruding triple-mode cavity resonance structure is internally provided with at least two nonparallel arranged coupling devices for changing orthogonal properties of a degenerate triple-mode electromagnetic field in the cavity, each coupling device comprises cut comers/chamfers/grooves disposed on edges of the dielectric resonance block, or comprises chamfers/cut corners disposed at inner corners of the cavity, or comprises cut corners/chamfers/grooves disposed beside edges of the dielectric resonance block and chamfers/cut corners beside edges of the cavity, or comprises tapping lines or/pieces arranged on nonparallel planes in the cavity;

the cut corners take a shape of a triangular prism or a cuboid or a sector; after corner cutting, in case of frequency holding, side lengths of the dielectric resonance block are increased, and the Q value is slightly decreased:

depths of the cut corners or holes are of through or partial cut corners/partial hole structures according to required coupling amounts;

the coupling amounts are affected by sizes of the cut corners/chamfers/holes;

a coupling tuning structure comprises a coupling screw disposed in a direction perpendicular or parallel to the cut corners; the coupling screw is made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs. medium discs with metallic discs and medium rods with medium discs.

53. The outwardly protruding triple-mode cavity resonance structure as claimed in claim 45, wherein the outwardly protruding triple-mode cavity resonance structure is internally provided with at least two nonparallel arranged coupling devices for changing orthogonal properties of a degenerate triple-triode electromagnetic field in the cavity, each coupling device comprises holes/grooves arranged on an end face of the dielectric resonance block; central lines of the holes or grooves are parallel to edges perpendicular to the end surfaces with the holes or the grooves of the dielectric resonance block, or each coupling device comprises chamfers/cut corners arranged at inner corners of the cavity, or comprises holes/grooves arranged in the end faces of the dielectric resonance block and chamfers/cut corners beside edges of the cavity, or comprises tapping lines or/pieces arranged on nonparallel planes in the cavity;

depths of the holes are of through hole structures or partial hole structures according to required coupling amounts;

the coupling amounts are affected by the sizes of the holes;

the holes/grooves take a shape of a circle, a rectangle or a polygon, and after the holes/grooves are formed, in case of frequency holding, side lengths of the dielectric resonance block are increased, and the Q value is slightly decreased;

a coupling tuning structure comprises a coupling screw arranged in a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; and the coupling screw takes a shape of any one of metallic rods, medium rods, metallic discs, medium discs, metallic rods with metallic discs, metallic rods with medium discs, medium discs with metallic discs and medium rods with medium discs.

54. The outwardly protruding triple-mode cavity resonance structure as claimed in claim 45, wherein the cavity takes the cube-like shape; to achieve coupling of three modes, on premise that the size of the dielectric resonance block is not changed, cut sides for achieving coupling of the three modes are processed on any two adjacent faces of the cavity; sizes of the cut sides are relevant to required coupling amounts; coupling of two of the three modes is achieved through the cut sides, of the cavity; other coupling is achieved through cut corners of two adjacent sides of the cavity; walls are not broken when corners of the adjacent sides of the cavity are cut; cut corner faces need to be completely sealed with the cavity; a surface of the cavity is electroplated by copper or electroplated by silver; the cavity is made of a metal or a nonmetal material; and when the cavity is made of the nonmetal material, the inner wall of the cavity is electroplated by a conductive material.

55. The outwardly protruding triple-mode cavity resonance structure as claimed in claim 45, wherein when the cavity takes the cube-like shape, the dielectric resonance block and the dielectric support frame are installed in any one axial direction of the cavity, and a center of the dielectric resonance block coincides with or approaches to a center of the cavity.

56. The outwardly protruding triple-mode cavity resonance structure as claimed in claim 45, wherein the dielectric constant of the dielectric support frame is similar to an air dielectric constant; the dielectric support frame is free of influence upon triple-mode resonance frequencies; the dielectric support frame supports with any one single face of the dielectric resonance block, or supports with six faces, or supports with different combinations of two different faces, three faces, four faces and five faces; a number of the dielectric support frame on each face is one or more; and one or more support frames is installed on different faces according to demands.

57. The outwardly protruding triple-mode cavity resonance structure as claimed in claim 45, wherein the dielectric constant of the dielectric support frame is greater than an air dielectric constant and smaller than the dielectric constant of the dielectric resonance block; to hold original triple-mode frequencies, a size corresponding to an axial direction of the dielectric resonance block of the dielectric support frame is slightly reduced; the dielectric support frame supports with any one single face of the dielectric resonance block, or supports with six faces, or supports with different combinations of two different faces, three faces, four faces and five faces; a face without the support frame is an air face; the air face is arbitrarily combined with the dielectric support frame; a number of the dielectric support frame on each face is one or more, or the dielectric support frame on each face is a complex dielectric constant support frame composed of multiple layers of different dielectric constant medium materials; single-layer and multi-layer medium material, support frames are arbitrarily combined with cube-like medium blocks; one or more dielectric support frames is installed on different faces according to demands; on faces with the dielectric support frames, to hold the triple-mode frequencies and the Q value, the size corresponding to the axial direction of the dielectric resonance block of the dielectric support frame is slightly reduced.

58. The outwardly protruding triple-mode cavity resonance structure as claimed in claim 45, wherein a surface area of the dielectric support frame is smaller than or equal to a surface area of the dielectric resonance block; the dielectric support frame is a cylinder, a cube or a cuboid;

the dielectric support frame is of a solid structure or hollow structure; the dielectric support frame of the hollow structure comprises a single hole or multiple holes; each hole takes a shape of a circle, a square, a polygon and an arc; and the dielectric support frame is made of air, plastics, ceramics and mediums.

59. The outwardly protruding triple-mode cavity resonance structure as claimed in claim 45, wherein the dielectric support frame and the dielectric resonance block are connected in a mode of crimping, adhesion or sintering;

and the dielectric support frame and the inner wall of the cavity are connected in a mode of adhesion, crimping, welding, sintering or screw fixation.

60. The outwardly protruding triple-mode cavity resonance structure as claimed in claim 45, wherein a radio frequency channel formed by coupling of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

61. The outwardly protruding triple-mode cavity resonance structure as claimed in claim 45, wherein a frequency temperature coefficient of the dielectric resonance block is controlled by adjusting proportions of medium materials, and is compensated according to frequency deviation variation of a filter at different temperatures.

62. A filter with a outwardly protruding triple-mode cavity resonance structure, comprising a cavity, a cover plate and an input/output structure, wherein the cavity is internally provided with at least one outwardly protruding triple-mode cavity resonance structure as claimed in claim 45;

the outwardly protruding triple-mode cavity resonance structure is combined with a single-mode resonance structure, a dual-mode resonance structure and a triple-mode resonance structure in different modes to form filters of different volumes;

a coupling of any two resonance cavities formed by permutation and combination of the outwardly protruding triple-mode cavity resonance structure and any one of the single-mode resonance structure, the dual-mode resonance structure and the triple-mode resonance structure is achieved through a size of a window between the two resonance cavities, necessarily when resonance rods in the two resonance cavities are parallel, and the size of the window is determined according to a coupling amount; and the filter has function properties of band pass, band stop, high pass, low pass and a duplexer, a multiplexer and a combiner formed thereby.

* * * * *